US009528174B2

(12) United States Patent
Sawtell et al.

(10) Patent No.: US 9,528,174 B2
(45) Date of Patent: Dec. 27, 2016

(54) ALUMINUM ALLOYS AND METHODS FOR PRODUCING THE SAME

(71) Applicant: Alcoa Inc., Pittsburgh, PA (US)

(72) Inventors: Ralph R. Sawtell, Gibsonia, PA (US); John M. Newman, Export, PA (US); Thomas N. Rouns, Pittsburgh, PA (US); Raymond J. Kilmer, Pittsburgh, PA (US)

(73) Assignee: Arconic Inc., Pittsburgh, PA (US)

( * ) Notice: Subject to any disclaimer, the term of this patent is extended or adjusted under 35 U.S.C. 154(b) by 208 days.

(21) Appl. No.: 13/943,126

(22) Filed: Jul. 16, 2013

(65) Prior Publication Data

US 2014/0000768 A1 Jan. 2, 2014

Related U.S. Application Data

(63) Continuation of application No. 13/774,810, filed on Feb. 22, 2013.

(60) Provisional application No. 61/762,540, filed on Feb. 8, 2013, provisional application No. 61/732,100, filed on Nov. 30, 2012, provisional application No. 61/677,321, filed on Jul. 30, 2012, provisional application No. 61/660,347, filed on Jun. 15, 2012.

(51) Int. Cl.

| | |
|---|---|
| ***C22F 1/05*** | (2006.01) |
| ***C22F 1/047*** | (2006.01) |
| ***C22C 21/08*** | (2006.01) |

(52) U.S. Cl.

CPC ..... *C22F 1/05* (2013.01); *C22C 21/08* (2013.01); *C22F 1/047* (2013.01)

(58) Field of Classification Search

CPC ..... C22C 21/06; C22C 21/08; C22F 1/047; C22F 1/05

USPC ..... 148/552

See application file for complete search history.

(56) References Cited

U.S. PATENT DOCUMENTS

| | | | | |
|---|---|---|---|---|
| 4,061,178 | A * | 12/1977 | Sivilotti | B22D 11/0605 164/149 |
| 5,772,799 | A * | 6/1998 | Sun et al. | 148/439 |
| 5,909,764 | A * | 6/1999 | Sartschev | B22D 11/0605 164/431 |
| 6,672,368 | B2 * | 1/2004 | Unal | 164/480 |
| 2002/0150498 | A1 * | 10/2002 | Chakrabarti | C22F 1/053 420/532 |
| 2005/0211350 | A1 * | 9/2005 | Unal | C22F 1/04 148/694 |
| 2010/0119407 | A1 * | 5/2010 | Unal et al. | 420/542 |

* cited by examiner

*Primary Examiner* — Jessee Roe
*Assistant Examiner* — Jenny Wu
(74) *Attorney, Agent, or Firm* — Greenberg Traurig, LLP

(57) ABSTRACT

Heat treatable aluminum alloy strips and methods for making the same are disclosed. The heat treatable aluminum alloy strips are continuously cast and quenched, with optional rolling occurring before and/or after quenching. After quenching, the heat treatable aluminum alloy strip is neither annealed nor solution heat treated.

9 Claims, 16 Drawing Sheets

ALUMINUM ALLOYS AND METHODS FOR PRODUCING THE SAME

CROSS-REFERENCE TO RELATED APPLICATIONS

This patent application is a continuation of U.S. Non-provisional patent application No. 13/774,810, filed Feb. 22, 2013, and claims priority to U.S. Provisional Patent Application No. 61/660,347, filed Jun. 15, 2012, and U.S. Provisional Patent Application No. 61/677,321, filed Jul. 30, 2012, and U.S. Provisional Patent Application No. 61/732,100, filed Nov. 30, 2012, and U.S. Provisional Patent Application No. 61/762,540, filed Feb. 8, 2013. Each of the above-identified patent application is incorporated herein by reference in its entirety.

BACKGROUND

Aluminum alloys are useful in a variety of applications. However, improving one property of an aluminum alloy without degrading another property is elusive. For example, it is difficult to increase the strength of an alloy without decreasing the toughness of an alloy. Other properties of interest for aluminum alloys include corrosion resistance and fatigue crack growth resistance, to name two.

SUMMARY OF THE DISCLOSURE

Broadly, the present patent application relates to improved methods of producing continuously cast heat treatable aluminum alloys. Specifically, the present patent application relates to improved methods of continuously casting and then quenching and then optionally aging heat treatable aluminum alloys.

One conventional process for producing continuously cast aluminum alloy products is illustrated in FIG. 1 from U.S. Pat. No. 7,182,825. In this process, a continuously-cast aluminum alloy strip feedstock (1) is optionally passed through shear and trim stations (2), optionally quenched for temperature adjustment (4), hot-rolled (6), and optionally trimmed (8). The feedstock is then either annealed (16) followed by suitable quenching (18) and optional coiling (20) to produce O temper products (22), or is solution heat treated (10), followed by suitable quenching (12) and optional coiling (14) to produce T temper products (24).

One embodiment of a new method for producing new continuously cast heat treatable aluminum alloys is illustrated in FIG. 2. In the illustrated embodiment, a heat treatable aluminum alloy is continuously cast as a strip (100), after which it is hot rolled (120), and then quenched (140). After the quenching step (140), the heat treatable aluminum alloy may be cold rolled (160) and/or artificially aged (180). Notably, after the quenching step (140), the heat treatable aluminum alloy is neither annealed nor solution heat treated (i.e., after the quenching step (140), the method excludes both (i) annealing of the heat treatable aluminum alloy, and (ii) solution heat treating of the heat treatable aluminum alloy); this is because it has been found that such anneal or solution heat treating steps may detrimentally impact the properties of the continuously cast heat treatable aluminum alloys, as shown below. Also, alloy products excluding both (i) an anneal step and (ii) a solution heat treatment step after the quenching step (140) may achieve comparable properties to alloy products having either (i) an anneal step or (ii) a solution heat treatment step after the quenching step (140), resulting in increased throughput of the new alloy products and with little or no degradation of properties relative to such alloy products having either (i) an annealing step, or (ii) a solution heat treatment step after the quenching step (140), and, in some instances, with improved properties, as shown below.

The continuously cast aluminum alloy is a heat treatable aluminum alloy. For purposes of the present patent application, a heat treatable aluminum alloy is any aluminum alloy that realizes at least a 1 ksi increase in strength (as compared to the as-cast condition) due to naturally aging or artificial aging (i.e., is precipitation hardenable). For purposes of the present patent application, some non-limiting examples of aluminum alloys that may be heat treatable using the new processes disclosed herein include the 2xxx (copper based), 3xxx (manganese based), 4xxx (silicon based), 5xxx (magnesium based), 6xxx (magnesium and silicon based), 7xxx (zinc based), and some 8xxx aluminum alloys, when such alloys include sufficient precipitatable solute to facilitate a 1 ksi aging response, among other aluminum alloys, as described in further detail below.

A. Continuous Casting

The continuously casting step (100) may be accomplished via any continuous casting apparatus capable of producing continuously cast strips that are solidified at high solidification rates. High solidification rates facilitate retention of alloying elements in solid solution. The solid solution formed at high temperature may be retained in a supersaturated state by cooling with sufficient rapidity to restrict the precipitation of the solute atoms as coarse, incoherent particles. In one embodiment, the solidification rate is such that the alloy realizes a secondary dendrite arm spacing of 10 micrometers, or less (on average). In one embodiment, the secondary dendrite arm spacing is not greater than 7 micrometers. In another embodiment, the secondary dendrite arm spacing is not greater than 5 micrometers. In yet another embodiment, the secondary dendrite arm spacing is not greater than 3 micrometers. One example of a continuous casting apparatus capable of achieving the above-described solidification rates is the apparatus described in U.S. Pat. Nos. 5,496,423 and 6,672,368. In these apparatus, the strip typically exits the rolls of the casting at about 1100° F. It may be desirable to lower the strip temperature to about 1000° F. within about 8 to 10 inches of the nip of the rolls to achieve the above-described solidification rates. In an embodiment, the nip of the rolls may be a point of minimum clearance between the rolls.

To continuously cast, and as illustrated in FIGS. 3-4, a molten aluminum alloy metal M may be stored in a hopper H (or tundish) and delivered through a feed tip T, in a direction B, to a pair of rolls $R_1$ and $R_2$, having respective roll surfaces $D_1$ and $D_2$, which are each rotated in respective directions $A_1$ and $A_2$, to produce a solid strip S. In an embodiment, gaps $G_1$ and $G_2$ may be maintained between the feed tip T and respective rolls $R_1$ and $R_2$ as small as possible to prevent molten metal from leaking out, and to minimize the exposure of the molten metal to the atmosphere, while maintaining a separation between the feed tip T and rolls $R_1$ and $R_2$. A suitable dimension of the gaps $G_1$ and $G_2$ may be 0.01 inch (0.254 mm). A plane L through the centerline of the rolls $R_1$ and $R_2$ passes through a region of minimum clearance between the rolls $R_1$ and $R_2$ referred to as the roll nip N.

In an embodiment, during the casting step (100), the molten metal M directly contacts the cooled rolls $R_1$ and $R_2$ at regions 2 and 4, respectively. Upon contact with the rolls $R_1$ and $R_2$, the metal M begins to cool and solidify. The cooling metal produces an upper shell 6 of solidified metal adjacent the roll $R_1$ and a lower shell 8 of solidified metal adjacent to the roll $R_2$. The thickness of the shells 6 and 8 increases as the metal M advances towards the nip N. Large dendrites 10 of solidified metal (not shown to scale) may be produced at the interfaces between each of the upper and lower shells 6 and 8 and the molten metal M. The large dendrites 10 may be broken and dragged into a center portion 12 of the slower moving flow of the molten metal M and may be carried in the direction of arrows $C_1$ and $C_2$. The dragging action of the flow can cause the large dendrites 10 to be broken further into smaller dendrites 14 (not shown to scale). In the central portion 12 upstream of the nip N referred to as a region 16, the metal M is semi-solid and may include a solid component (the solidified small dendrites 14) and a molten metal component. The metal M in the region 16 may have a mushy consistency due in part to the dispersion of the small dendrites 14 therein. At the location of the nip N, some of the molten metal may be squeezed backwards in a direction opposite to the arrows $C_1$ and $C_2$. The forward rotation of the rolls $R_1$ and $R_2$ at the nip N advances substantially only the solid portion of the metal (the upper and lower shells 6 and 8 and the small dendrites 14 in the central portion 12) while forcing molten metal in the central portion 12 upstream from the nip N such that the metal may be completely solid as it leaves the point of the nip N. In this manner and in an embodiment, a freeze front of metal may be formed at the nip N. Downstream of the nip N, the central portion 12 may be a solid central layer, or region, 18 containing the small dendrites 14 sandwiched between the upper shell 6 and the lower shell 8. In the central layer, or region, 18, the small dendrites 14 may be 20 microns to 50 microns in size and have a generally globular shape. The three layers, or regions, of the upper and lower shells 6 and 8 and solidified central layer 18 constitute a single, solid cast strip (S in FIG. 3 and element 20 in FIG. 4). Thus, the aluminum alloy strip 20 may include a first layer, or region, of an aluminum alloy and a second layer, or region, of the aluminum alloy (corresponding to the shells 6 and 8) with an intermediate layer, or region (the solidified central layer 18) therebetween. The solid central layer, or region, 18 may constitute 20 percent to 30 percent of the total thickness of the strip 20. The concentration of the small dendrites 14 may be higher in the solid central layer 18 of the strip 20 than in the semi-solid region 16 of the flow, or the central portion 12.

The molten aluminum alloy may have an initial concentration of alloying elements including peritectic forming alloying elements and eutectic forming alloying elements, such as any of the alloying elements described below. Examples of alloying elements that are peritectic formers with aluminum include Ti, V, Zr and Cr. Examples of eutectic formers with aluminum include Si, Mg, Cu, Mn, Zn, Fe, and Ni. During solidification of an aluminum alloy melt, dendrites typically have a lower concentration of eutectic formers than the surrounding mother melt and higher concentration of peritectic formers. In the region 16, in the center region upstream of the nip, the small dendrites 14 are thus partially depleted of eutectic formers while the molten metal surrounding the small dendrites is somewhat enriched in eutectic formers. Consequently, the solid central layer, or region, 18 of the strip 20, which contains a large population of dendrites, is depleted of eutectic formers and is enriched in peritectic formers in comparison to the concentration of the eutectic formers and the peritectic formers in the upper shell 6 and the lower shell 8. In other words, the concentration of eutectic forming alloying elements in the central layer, or region, 18 is generally less than in the first layer, or region, 6 and second layer, or region, 8. Similarly, the concentration of peritectic forming alloying elements in the central layer, or region, 18 is generally greater than in the first layer, or region, 6 and second layer, or region, 8. Thus, in some embodiments, a continuously cast aluminum alloy strip comprises a larger amount (higher average through thickness concentration in that region) of at least one of Si, Mg, Cu, Mn, Zn, Fe, and Ni in the upper region or lower region of the alloy product as compared to the amount of Si, Mg, Cu, Mn, Zn, Fe, and/or Ni at the centerline of the aluminum alloy product, wherein the concentration in these regions is determined using the Concentration Profile Procedure, described below.

In one embodiment, an aluminum alloy strip comprises a higher concentration (by weight) of one or more eutectic formers in the upper region or lower region of the alloy product, relative to the concentration of those same eutectic formers at the centerline of the strip. In one embodiment, an aluminum alloy strip comprises a higher concentration of one or more eutectic formers in both the upper region and the lower region of the alloy product relative to the concentration of those same eutectic former(s) at the centerline of the strip. In one embodiment, an aluminum alloy strip comprises at least a 1% higher concentration of at least one eutectic former(s) (average concentration in the upper or lower region, as applicable) relative to the concentration of those same eutectic former(s) at the centerline of the strip. For example, if an aluminum alloy strip comprises both magnesium and silicon, which are eutectic formers, the upper region and/or the lower region of the aluminum alloy strip would contain at least 1% more of magnesium and/or silicon (and sometimes at least 1% more of both magnesium and silicon) relative to the amount of magnesium and/or silicon at the centerline of the strip. In one embodiment, an aluminum alloy strip comprises at least a 3% higher concentration of at least one eutectic former(s) (average concentration in the upper or lower region, as applicable) relative to the concentration of those same eutectic former(s) at the centerline of the strip. In one embodiment, an aluminum alloy strip comprises at least a 5% higher concentration of at least one eutectic former(s) (average concentration in the upper or lower region, as applicable) relative to the concentration of those same eutectic former(s) at the centerline of the strip. In one embodiment, an aluminum alloy strip comprises at least a 7% higher concentration of at least one eutectic former(s) (average concentration in the upper or lower region, as applicable) relative to the concentration of those same eutectic former(s) at the centerline of the strip. In one embodiment, an aluminum alloy strip comprises at least a 9% higher concentration of at least one eutectic former(s) (average concentration in the upper or lower region, as applicable) relative to the concentration of those same eutectic former(s) at the centerline of the strip.

Concentration Profile Procedure

1. Sample Preparation

Aluminum sheet samples are mounted in Lucite and the longitudinal surface (see, FIG. 15) is polished using the standard metallographic preparation procedure (ref: ASTM E3-01 (2007) Standard Guide for Preparation of Metallographic Specimens). The polished surface of the samples is coated with carbon using commercially available carbon coating equipment. The carbon coating is a few microns thick.

2. Electron Probe Micro Analysis (EPMA) Equipment

A JEOL JXA8600 Superprobe is used to obtain through-thickness composition profiles in the prepared aluminum sheet samples. The Superprobe has four Wave Dispersive Spectrometer (WDS) detectors, two of which are gas flow (P-10) counters, and the others being Xe-gas sealed counters. The detection range of elements is from Beryllium (Be) to Uranium (U). The quantitative analysis detection limit is 0.02 wt %. The instrument is equipped with Geller Microanalytical Dspec/Dquant automation which allows stage control and unattended quantitative and qualitative analysis.

3. Electron Probe Micro Analysis (EPMA) Analysis Procedure

The Superprobe is set to the following conditions: accelerating voltage 15 kV, beam intensity 100 nA, defocus electron beam to an appropriate size such that a minimum of 13 different sections of the sample can be measured (e.g., defocused to 100 μm for a 0.060 inch thick specimen), and exposure time for each element is 10 seconds. Background correction was done for the sample surface at three random locations with a counting time of 5 seconds on positive and negative backgrounds.

One EPMA linescan is defined as scanning the whole thickness of the sheet samples at multiple locations along a straight line perpendicular to the rolling direction of the sample. An odd number of spots are used, with the mid-number spots at the center line of the sheet sample. The spacing between the spots is equivalent to the beam diameter. At each spot, any of the following elements may be analyzed, as appropriate: Mn, Cu, Mg, Zn, Si, and Fe. Si is analyzed by a PET diffracting crystal with a gas flow (P-10) counter; Fe, Cu, Zn, and Mn are by a LIF diffracting crystal with a Xe-gas sealed counter; Mg is analyzed by a TAP diffracting crystal with a gas flow (P-10) counter. The counting time for each element is 10 seconds. This linescan is repeated 30 times down the length of the sheet sample. At any one location of the sample, the reported composition of each element should be the averaged value of 30 measurements at the same thickness locations The concentration in the upper and lower regions is the average measured concentration in each of these regions, excluding (i) the edge (surface) of the upper region and the lower region and (ii) the transition zone between the center region and each of the upper region and the lower region. The concentration of an element must be measured at a minimum of four (4) different locations in each of the upper and lower regions to determine the average concentration of such element in each of those regions.

Elements measured were calibrated using the DQuant analysis package CITZAF, v4.01 with ZAF/Phi(pz) correction model Heinrich/Duncumb-Reed. This technique comes from Dr. Curt Heinrich of NIST, using a traditional Duncumb-Reed absorption correction.(see, Heinrich, Microbeam Analysis-1985, 79;-1989, 223)

The rolls $R_1$ and $R_2$ may serve as heat sinks for the heat of the molten metal M. In one embodiment, heat may be transferred from the molten metal M to the rolls $R_1$ and $R_2$ in a uniform manner to ensure uniformity in the surface of the cast strip 20. Surfaces $D_1$ and $D_2$ of the respective rolls $R_1$ and $R_2$ may be made from steel or copper and may be textured and may include surface irregularities (not shown) which may contact the molten metal M. The surface irregularities may serve to increase the heat transfer from the surfaces $D_1$ and $D_2$ and, by imposing a controlled degree of non-uniformity in the surfaces $D_1$ and $D_2$, result in uniform heat transfer across the surfaces $D_1$ and $D_2$. The surface irregularities may be in the form of grooves, dimples, knurls or other structures and may be spaced apart in a regular pattern of 20 to 120 surface irregularities per inch, or about 60 irregularities per inch. The surface irregularities may have a height ranging from 5 microns to 50 microns, or alternatively about 30 microns. The rolls $R_1$ and $R_2$ may be coated with a material to enhance separation of the cast strip from the rolls $R_1$ and $R_2$ such as chromium or nickel.

The control, maintenance and selection of the appropriate speed of the rolls $R_1$ and $R_2$ may impact the ability to continuously cast strips. The roll speed determines the speed that the molten metal M advances towards the nip N. If the speed is too slow, the large dendrites 10 will not experience sufficient forces to become entrained in the central portion 12 and break into the small dendrites 14. In an embodiment, the roll speed may be selected such that a freeze front, or point of complete solidification, of the molten metal M may form at the nip N. Accordingly, the present casting apparatus and methods may be suited for operation at high speeds such as those ranging from 25 to 400 feet per minute; alternatively from 50 to 400 feet per minute; alternatively from 100 to 400 feet per minute; and alternatively from 150 to 300 feet per minute. The linear rate per unit area that molten aluminum is delivered to the rolls $R_1$ and $R_2$ may be less than the speed of the rolls $R_1$ and $R_2$ or about one quarter of the roll speed. High-speed continuous casting may be achievable with the presently disclosed apparatus and methods, at least in part, because the textured surfaces $D_1$ and $D_2$ facilitate uniform heat transfer from the molten metal M. Due to such high casting speeds and associated rapid solidification rates, the soluble constituents may be substantially retained in solid solution.

The roll separating force may be a parameter in using the presently disclosed casting apparatus and methods. One benefit of the presently disclosed continuous casting apparatus and methods may be that solid strip is not produced until the metal reaches the nip N. The thickness is determined by the dimension of the nip N between the rolls $R_1$ and $R_2$. The roll separating force may be sufficiently great to squeeze molten metal upstream and away from the nip N. Excessive molten metal passing through the nip N may cause the layers of the upper and lower shells 6 and 8 and the solid central region 18 to fall away from each other and become misaligned. Insufficient molten metal reaching the nip N may cause the strip to form prematurely. A prematurely formed strip may be deformed by the rolls $R_1$ and $R_2$ and experience centerline segregation. Suitable roll separating forces may range from 25 to 300 pounds per inch of width cast, or 100 pounds per inch of width cast. In general, slower casting speeds may be needed when casting thicker gauge strips in order to remove the heat. Such slower casting speeds do not result in excessive roll separating forces because fully solid aluminum strip is not produced upstream of the nip. The grains in the aluminum alloy strip 20 are substantially undeformed because the force applied by the rolls is low (300 pounds per inch of width or less). Furthermore, since the strip 20 is not solid until it reaches the nip N; it will not be "hot rolled". Thus, the strip 20 does not receive a thermo-mechanical treatment due to the casting process itself, and when not subsequently rolled, the grains in the strip 20 will generally be substantially undeformed, retaining their initial structure achieved upon solidification, i.e. an equiaxial structure, such as globular.

The roll surfaces $D_1$ and $D_2$ may heat up during casting and are may be prone to oxidation at elevated temperatures. Non-uniform oxidation of the roll surfaces during casting can change the heat transfer properties of the rolls $R_1$ and $R_2$. Hence, the roll surfaces $D_1$ and $D_2$ may be oxidized prior to use to minimize changes thereof during casting. It may be beneficial to brush the roll surfaces $D_1$ and $D_2$ from time-to-time, or continuously, to remove debris which may build up during casting of aluminum and aluminum alloys. Small pieces of the cast strip may break free from the strip S and adhere to the roll surfaces $D_1$ and $D_2$. These small pieces of aluminum alloy strip may be prone to oxidation, which may result in non-uniformity in the heat transfer properties of the roll surfaces $D_1$ and $D_2$. Brushing of the roll surfaces $D_1$ and $D_2$ avoids the non-uniformity problems from debris which may collect on the roll surfaces $D_1$ and $D_2$.

Continuous casting of aluminum alloys according to the present disclosure may be achieved by initially selecting the desired dimension of the nip N corresponding to the desired gauge of the strip S. The speed of the rolls $R_1$ and $R_2$ may be increased to a desired production rate or to a speed which is less than the speed which causes the roll separating force increases to a level which indicates that rolling is occurring between the rolls $R_1$ and $R_2$. Casting at the rates contemplated by the present invention (i.e. 25 to 400 feet per minute) solidifies the aluminum alloy strip about 1000 times faster than aluminum alloy cast as an ingot cast and improves the properties of the strip over aluminum alloys cast as an ingot. The rate at which the molten metal is cooled may be selected to achieve rapid solidification of the outer regions of the metal. Indeed, the cooling of the outer regions of metal may occur at a rate of at least 1000 degrees centigrade per second.

The continuous cast strip may be of any suitable thickness, and is generally of sheet gauge (0.006 inch to 0.249 inch) or thin-plate gauge (0.250 inch to 0.400 inch), i.e., has a thickness in the range of from 0.006 inch to 0.400 inch. In one embodiment, the strip has a thickness of at least 0.040 inch. In one embodiment, the strip has a thickness of at not greater than 0.320 inch. In one embodiment, the strip has a thickness of from 0.0070 to 0.018, such as when used for food and/or beverage containers.

B. Rolling and/or Quenching

Once the continuously cast strip is removed from the casting apparatus, i.e., after the continuously casting step (100), the continuously cast strip may be hot rolled (120), such as to final gauge or an intermediate gauge. In this regard, the heat treatable aluminum alloy strip may exit the casting apparatus at a temperature below the alloy solidus temperature, which is alloy dependent, and generally in the range of from 900° F. to 1150° F.

In this embodiment, after the hot rolling step (120), the strip is quenched (140). In this regard, the heat treatable aluminum alloy strip may exit the hot rolling apparatus at a temperature of from 550° F. to 900F° , or higher. The quenching step (140) may thus comprise cooling the aluminum alloy strip at a rate of at least 10° F. per second. In one embodiment, the quenching step (140) comprises cooling the aluminum alloy strip at a rate of at least 25° F. per second. In another embodiment, the quenching step (140) comprises cooling the aluminum alloy strip at a rate of at least 50° F. per second. In this regard, the method may comprise removing the aluminum alloy strip from a hot rolling apparatus, and, after the removing step, but before the aluminum alloy strip reaches a temperature of 550° F., quenching the aluminum alloy strip (140). In this regard, the temperature of the aluminum alloy strip as it exits the continuous casting apparatus and as it exits the hot rolling apparatus is higher than the temperature of the aluminum alloy strip after it completes the quenching step (140). In one embodiment, the quenching step (140) is initiated before the aluminum alloy strip reaches a temperature of 600° F.

In another embodiment, the quenching step (140) is initiated before the aluminum alloy strip reaches a temperature of 650° F. In yet another embodiment, the quenching step (140) is initiated before the aluminum alloy strip reaches a temperature of 700° F. In another embodiment, the quenching step (140) is initiated before the aluminum alloy strip reaches a temperature of 750° F. In yet another embodiment, the quenching step (140) is initiated before the aluminum alloy strip reaches a temperature of 800° F. In another embodiment, the quenching step (140) is initiated before the aluminum alloy strip reaches a temperature of 850° F. In yet another embodiment, the quenching step (140) is initiated before the aluminum alloy strip reaches a temperature of 900° F. In another embodiment, the quenching step (140) is initiated before the aluminum alloy strip reaches a temperature of 950° F. In yet another embodiment, the quenching step (140) is initiated before the aluminum alloy strip reaches a temperature of 1000° F. In another embodiment, the quenching step (140) is initiated before the aluminum alloy strip reaches a temperature of 1050° F. Similar quenching rates and temperatures of quench initiation may be employed in embodiments when rolling is employed after quenching, or when no rolling is applied (described below).

In one embodiment, the quenching step (140) reduces the temperature of the aluminum alloy strip at a rate of at least 100° F. per second. In another embodiment, the quenching step (140) reduces the temperature of the aluminum alloy strip at a rate of at least 200° F. per second. In yet another embodiment, the quenching step (140) reduces the temperature of the aluminum alloy strip at a rate of at least 400° F. per second. In another embodiment, the quenching step (140) reduces the temperature of the aluminum alloy strip at a rate of at least 800° F. per second. In yet another embodiment, the quenching step (140) reduces the temperature of the aluminum alloy strip at a rate of at least 1600° F. per second. In another embodiment, the quenching step (140) reduces the temperature of the aluminum alloy strip at a rate of at least 3200° F. per second. In yet another embodiment, the quenching step (140) reduces the temperature of the aluminum alloy strip at a rate of at least 6400° F. per second. Similar quenching rates may be employed in embodiments when rolling is employed after quenching, or when no rolling is applied (described below).

The quenching step (140) may be accomplished to bring the aluminum alloy strip to a low temperature (e.g., due to the optional subsequent cold working (160) and/or artificial aging steps (180)). In one embodiment, the quenching step (140) comprises cooling the aluminum alloy strip to a temperature of not greater than 400° F. (i.e., the temperature of the aluminum alloy strip upon completion of the quenching step (140) is not greater than 400° F.). In another embodiment, the quenching step (140) comprises cooling the aluminum alloy strip to a temperature of not greater than 350° F. In yet another embodiment, the quenching step (140) comprises cooling the aluminum alloy strip to a temperature of not greater than 300° F. In another embodiment, the quenching step (140) comprises cooling the aluminum alloy strip to a temperature of not greater than 250° F. In yet another embodiment, the quenching step (140) comprises cooling the aluminum alloy strip to a temperature of not greater than 200° F. In another embodiment, the quenching step (140) comprises cooling the aluminum alloy strip to a temperature of not greater than 150° F. In yet another embodiment, the quenching step (140) comprises cooling the aluminum alloy strip to a temperature of not greater than 100° F. In another embodiment, the quenching step (140) comprises cooling the aluminum alloy strip to ambient temperature.

In one embodiment, the quenching step may be accomplished to bring the aluminum alloy strip to a suitable artificial aging temperature, wherein the aluminum alloy is artificially aged (180) after the cooling step. In this embodiment, the quenching step (140) comprises cooling the aluminum alloy strip to a temperature of not greater than 400° F. (i.e., the temperature of the aluminum alloy strip upon completion of the quenching step (140) is not greater than 400° F.), or other suitable artificial aging temperature.

The quenching step (140) may be accomplished via any suitable cooling medium, such as via a liquid (e.g., via an aqueous or organic solution, or mixtures thereof), a gas (e.g., air cooling), or even a solid (e.g., cooled solids on one or more sides of the aluminum alloy strip). In one embodiment, the quenching step (140) comprises contacting the aluminum alloy strip with a gas. In one embodiment, the gas is air. In one embodiment, the quenching step (140) comprises contacting the aluminum alloy strip with a liquid. In one embodiment, the liquid is aqueous based, such as water or another aqueous based cooling solution. In one embodiment, the liquid is an oil. In one embodiment, the oil is hydrocarbon based. In another embodiment, the oil is silicone based. Mixtures may also be employed (e.g., mixed liquids, gas-liquid, solid-liquid, etc.). In one embodiment, the quench medium comprises a liquid having at least oil and water components. In some embodiments, the quenching step (140) is accomplished via a quenching apparatus downstream of the continuous casting apparatus. In other embodiments, ambient air cooling is used.

The quenching step (140) has generally been described above as being conducted after the hot rolling step (120). However, the quenching step may be also/alternatively be accomplished as part of/during the hot rolling step (e.g., where a coolant is applied during the rolling processes, such as applied to the rolls used for the hot rolling).

After the quenching step (140), the aluminum alloy may be cold rolled (160) and/or artificially aged (180). The optional cold rolling step (160), may reduce the thickness of the aluminum alloy strip anywhere from 1-2% to 90%, or more. In some embodiments, a hot rolling step may be used in conjunction with, or as a substitute for, the cold rolling step (160), so long as such a hot rolling step does not accomplish an anneal or a solution heat treatment.

The optional artificial aging step (180) may include heating the aluminum alloy strip at elevated temperature(s) (but below annealing and solution heat treatment temperatures) for one or more periods of time. In one embodiment, the continuously cast strip is at final gauge during the artificial aging step (180), and thus may be of a T5-type or T10-type temper after the artificial aging step (180). For instance, in embodiments where the aluminum alloy strip is at final gauge after quenching (140), the method excludes cold rolling (160), and when subsequently artificially aged (180), the aluminum alloy strip may be of a T5-type temper. In other embodiments where cold rolling (160) is completed after the quenching (140) and prior to artificial aging (180), the aluminum alloy strip may be of a T10-type temper after the artificial aging step (180). When the aluminum alloy strip is not artificially aged after the quenching step (140), the strip may be of a T2-type temper (cold worked after quenching) or of a T1-type temper (not cold worked after quenching). In yet other embodiments, some rolling, working or deformation (leveling) may occur after artificial aging, and in these embodiments the aluminum alloy strip may be of a T9-type temper (but not including a separate solution heat treatment step).

Another embodiment of a new method for producing new continuously cast heat treatable aluminum alloys is illustrated in FIG. 5. In this embodiment, after the continuous casting step (200) the continuously cast strip is quenched (220), after which it may be optionally rolled (240) (e.g. to a final or intermediate gauge), and then optionally artificially aged (260). The quenching step (220) may cool the cast strip to any suitable temperature, such as a temperature suitable for subsequent optional rolling (240) and or coiling (not illustrated), and at any of the cooling rates and to any of the temperatures described above relative to quenching step (140). When the optional rolling step (240) is employed, the quenching step (220) may comprise cooling the cast strip to a suitable rolling temperature. When the cast strip is to be "hot rolled" in the optional rolling step (240), the quenching step (220) comprises cooling the cast strip to a temperature of not greater than about 1050° F., but above 400° F. (i.e., cooling the strip to a temperature of from 401° F. to 1050° F.), as measured proximal the entry point of the rolling apparatus, ensuring that the entry temperature is sufficiently low to avoid "hot shortness". When the cast strip is to be "cold rolled" in the optional rolling step (240), the quenching step (220) comprises cooling the cast strip to a temperature of not greater than 400° F. to about ambient, such as any of the quenching temperatures described above relative to quenching step (140) of FIG. 2. Similar to FIG. 2, described above, after the initial quenching step (220), the heat treatable aluminum alloy is neither annealed nor solution heat treated (i.e., after the quenching step (220), the method excludes both (i) annealing of the heat treatable aluminum alloy, and (ii) solution heat treating of the heat treatable aluminum alloy).

When the optional rolling step (120 or 240) is employed, the method may optionally include quenching the strip during the optional rolling step (120 or 240). For instance, and as described above, a coolant may be applied during the rolling processes, such as applied to the rolls used for the rolling. Alternatively, and with reference now to FIG. 6, one or more separate quenching apparatus (610) may be used, wherein a quenching solution (615) is applied directly to an outer surface of the cast strip (620) after the cast strip exits a first set of rollers (605*a*) and prior to the cast strip entering a second set of rollers (605*b*). While two quenching apparatus (610) and two sets of rollers (605*a*, 605*b*) are illustrated in FIG. 6, any number of quenching apparatus and sets of rollers may be used to achieve the desired result.

FIG. 7 illustrates a particular embodiment of FIG. 5, where a hot rolling step (240H) is employed as optional rolling step (240) of FIG. 5. In this embodiment, after casting (200), the cast strip is quenched (220) in a quenching apparatus to a temperature of from 401° F. to 1050° F., after which it is hot rolled (240H) to an intermediate gauge or final gauge. After the hot rolling step (240H), the strip may be optionally quenched (140-O), optionally cold rolled (160), and/or optionally artificially aged (180). Optional quench step (140-O) may include any of the quenching operations/parameters described above relative to quench step (140) of FIG. 2. In the method of FIG,. 7, and as described above, after the initial quenching step (220), the heat treatable aluminum alloy is neither annealed nor solution heat treated (i.e., after the quenching step (220), the method excludes both (i) annealing of the heat treatable aluminum alloy, and (ii) solution heat treating of the heat treatable aluminum alloy).

C. Properties

As noted above, after the quenching step (140 or 240), the heat treatable aluminum alloy is neither annealed nor solution heat treated (i.e., after the quenching step (140 or 240), the method excludes both (i) annealing of the heat treatable aluminum alloy, and (ii) solution heat treating of the heat treatable aluminum alloy). Such thermal treatments may detrimentally impact the aluminum alloy. Also, alloy products excluding both (i) an anneal step and (ii) a solution heat treatment step after the quenching step (140) may achieve comparable properties to alloy products having either (i) an anneal step or (ii) a solution heat treatment step after the quenching step (140 or 240), resulting in increased throughput of the new alloy products and with little or no degradation of properties relative to such alloy products having either (i) an annealing step, or (ii) a solution heat treatment step after the quenching step (140), and, in some instances, with improved properties. As used herein, an anneal is a thermal treatment used to soften an aluminum alloy material, usually by exposing the aluminum alloy material to a temperature of at least 550° -600° F. A solution heat treatment step (or solutionizing step) is a thermal treatment used to solutionize an aluminum alloy material, usually by exposing the aluminum alloy material to a temperature of at least 850° -900° F. Thus, after the quenching step (140 or 240), the present method is absent of any purposeful thermal treatment steps that expose the aluminum alloy to temperatures of 550° F., or higher. Due to the absence of such thermal treatment steps, some elements, such as manganese, may be retained in solid solution, which may facilitate improvements in strength. Hence, the heat treatable aluminum alloys may have a lower electrical conductivity as compared to alloys having an anneal or solution heat treatment step after the quenching step (140 or 240).

In one embodiment, a new aluminum alloy strip realizes an electrical conductivity (EC) value (% IACS) that is at least 4 units lower than the EC value of a reference-version of the aluminum alloy strip (e.g., if a new aluminum alloy strip realizes an EC value of 25.6% IACS, a reference-version of the aluminum alloy strip would realize an EC value of 30.6% IACS, or higher). To produce a reference-version of the aluminum alloy strip for comparison to an aluminum alloy strip produced in accordance with the new methods disclosed herein ("new aluminum alloy strip"), one would continuously cast a heat treatable aluminum alloy strip, and then hot roll this aluminum alloy strip to final gauge, and then quench this aluminum alloy strip, as described above relative to FIG. 2. After the quenching step, this aluminum alloy strip is separated into at least a first portion and a second portion. The first portion of the aluminum alloy strip is then only artificially aged (i.e. this strip is neither subsequently annealed nor subsequently solution heat treated after the quenching step), thereby producing a "new aluminum alloy strip", i.e., an aluminum alloy strip produced in accordance with the new processes disclosed herein. Conversely, the second portion of the aluminum alloy strip is then solution heat treated, wherein the aluminum alloy strip is held at a temperature of not more 10° F. below the solvus temperature (i.e., $SHT_{temp} \geq solvus_{temp} - 10°$ F.) and for at least 30 minutes while avoiding melting, after which the aluminum alloy strip is then quenched, and then artificially aged using the same artificial aging conditions employed for the new aluminum alloy strip, thereby producing the "reference-version of the aluminum alloy strip". Since the new aluminum alloy strip and the reference-version of the aluminum alloy strip are produced from the same aluminum alloy strip, and since both strips are not further rolled after the quenching step, both strips will have the same composition and thickness. The properties (strength, elongation and/or EC, among others) of the "new aluminum alloy strip" can then be compared to the "reference-version of the aluminum alloy strip." As may be appreciated, multiple artificial aging times can be used to determine one or more properties at such aging times, and/or to facilitate generation of an appropriate aging curve(s), which aging curve(s) can be used to determine the peak strength of both the new aluminum alloy strip and the reference-version of the aluminum alloy strip.

In one embodiment, a new aluminum alloy strip realizes an EC value that is at least 5 units lower than the EC value of a reference-version of the aluminum alloy strip. In another embodiment, a new aluminum alloy strip realizes an EC value that is at least 6 units lower than the EC value of a reference-version of the aluminum alloy strip. In yet another embodiment, a new aluminum alloy strip realizes an EC value that is at least 7 units lower than the EC value of a reference-version of the aluminum alloy strip. In another embodiment, a new aluminum alloy strip realizes an EC value that is at least 8 units lower than the EC value of a reference-version of the aluminum alloy strip. In yet another embodiment, a new aluminum alloy strip realizes an EC value that is at least 9 units lower than the EC value of a reference-version of the aluminum alloy strip. In another embodiment, a new aluminum alloy strip realizes an EC value that is at least 10 units lower than the EC value of a reference-version of the aluminum alloy strip. EC may be tested using a Hocking Auto Sigma 3000DL electrical conductivity meter, or similar appropriate device.

In one embodiment, the reference-version of the aluminum alloy strip realizes at least 5% higher electrical conductivity as compared to the new aluminum alloy strip (e.g., if a new aluminum alloy strip realizes an EC value of 25.6% IACS, a reference-version of the aluminum alloy strip would realize an EC value of 26.88% IACS, or higher). In another embodiment, the reference-version of the aluminum alloy strip realizes at least 10% higher electrical conductivity as compared to the new aluminum alloy strip. In yet another embodiment, the reference-version of the aluminum alloy strip realizes at least 20% higher electrical conductivity as compared to the new aluminum alloy strip. In another embodiment, the reference-version of the aluminum alloy strip realizes at least 25% higher electrical conductivity as compared to the new aluminum alloy strip. In yet another embodiment, the reference-version of the aluminum alloy strip realizes at least 30% higher electrical conductivity as compared to the new aluminum alloy strip. In yet another embodiment, the reference-version of the aluminum alloy strip realizes at least 35% higher electrical conductivity as compared to the new aluminum alloy strip.

In one embodiment, a new aluminum alloy strip realizes a peak longitudinal (L) tensile yield strength ("P_TYS") that is at not more than 3 ksi lower than the peak longitudinal (L) tensile yield strength of the reference-version of the aluminum alloy strip ("P_TYS_R"). In other words:

$$P_TYS \geq (P_TYS_R - 3 \text{ ksi})$$

In another embodiment, a new aluminum alloy strip realizes a peak longitudinal (L) tensile yield strength (P_TYS) that is at not more than 2 ksi lower than the peak longitudinal (L) tensile yield strength of the reference-version of the aluminum alloy strip (P_TYS_R) (i.e., P_TYS≥(P_TYS_R−2 ksi). In yet another embodiment, a new aluminum alloy strip realizes a peak longitudinal (L) tensile yield strength that is at not more than 1 ksi lower than the peak longitudinal (L)

tensile yield strength of the reference-version of the aluminum alloy strip (i.e., P_TYS≥(P_TYS_R−1 ksi). In another embodiment, a new aluminum alloy strip realizes a peak longitudinal (L) tensile yield strength that is at least equivalent to the peak longitudinal (L) tensile yield strength of the reference-version of the aluminum alloy strip (i.e., P_TYS≥(P_TYS_R). In yet another embodiment, a new aluminum alloy strip realizes a peak longitudinal (L) tensile yield strength that is at least 1 ksi higher than the peak longitudinal (L) tensile yield strength of the reference-version of the aluminum alloy strip (i.e., P_TYS≥(P_TY_S R+1 ksi). In another embodiment, a new aluminum alloy strip realizes a peak longitudinal (L) tensile yield strength that is at least 2 ksi higher than the peak longitudinal (L) tensile yield strength of the reference-version of the aluminum alloy strip (i.e., P_TYS≥(P_TYS_R+2 ksi). In yet another embodiment, a new aluminum alloy strip realizes a peak longitudinal (L) tensile yield strength that is at least 3 ksi higher than the peak longitudinal (L) tensile yield strength of the reference-version of the aluminum alloy strip (i.e., P_TYS≥(P_TYS_R+3 ksi). In another embodiment, a new aluminum alloy strip realizes a peak longitudinal (L) tensile yield strength that is at least 4 ksi higher than the peak longitudinal (L) tensile yield strength of the reference-version of the aluminum alloy strip (i.e., P_TYS≥(P_TYS_R+4 ksi). In yet another embodiment, a new aluminum alloy strip realizes a peak longitudinal (L) tensile yield strength that is at least 5 ksi higher than the peak longitudinal (L) tensile yield strength of the reference-version of the aluminum alloy strip (i.e., P_TYS≥(P_TYS_R+5 ksi). In another embodiment, a new aluminum alloy strip realizes a peak longitudinal (L) tensile yield strength that is at least 6 ksi higher than the peak longitudinal (L) tensile yield strength of the reference-version of the aluminum alloy strip (i.e., P_TYS≥(P_TYS_R+6 ksi). In yet another embodiment, a new aluminum alloy strip realizes a peak longitudinal (L) tensile yield strength that is at least 7 ksi higher than the peak longitudinal (L) tensile yield strength of the reference-version of the aluminum alloy strip (i.e., P_TYS≥(P_TYS_R+7 ksi). In another embodiment, a new aluminum alloy strip realizes a peak longitudinal (L) tensile yield strength that is at least 8 ksi higher than the peak longitudinal (L) tensile yield strength of the reference-version of the aluminum alloy strip (i.e., P_TYS≥(P_TYS_R+8 ksi). In yet another embodiment, a new aluminum alloy strip realizes a peak longitudinal (L) tensile yield strength that is at least 9 ksi higher than the peak longitudinal (L) tensile yield strength of the reference-version of the aluminum alloy strip (i.e., P_TYS≥(P_TYS_R+9 ksi). In another embodiment, a new aluminum alloy strip realizes a peak longitudinal (L) tensile yield strength that is at least 10 ksi higher than the peak longitudinal (L) tensile yield strength of the reference-version of the aluminum alloy strip (i.e., P_TYS≥(P_TYS_R+10 ksi). In yet another embodiment, a new aluminum alloy strip realizes a peak longitudinal (L) tensile yield strength that is at least 11 ksi (or more) higher than the peak longitudinal (L) tensile yield strength of the reference-version of the aluminum alloy strip (i.e., P_TYS≥(P_TYS_R+11 ksi). "Tensile yield strength" is measured in accordance with ASTM E8 and B557. "Peak longitudinal (L) tensile yield strength" means the highest measured longitudinal (L) tensile yield strength of an aluminum alloy as determined using an appropriate aging curve. An appropriate aging curve is an aging curve that has a peak located between two lower measured tensile yield strength values, and utilizes a sufficient number of aging times so as to facilitate identification of a peak among the measured tensile yield strength values. An example appropriate aging curve is shown in FIG. 14.

D. Composition

As noted above, the continuously cast aluminum alloy is a heat treatable aluminum alloy, and thus may be of any composition that realizes at least a 1 ksi increase in strength (as compared to the as-cast condition) due to naturally aging or artificial aging (i.e., is precipitation hardenable). Thus, the heat treatable aluminum alloy may be any of 2xxx (copper based), 6xxx (magnesium and silicon based), and 7xxx (zinc based) aluminum alloys, when such alloys include sufficient precipitatable solute to facilitate a 1 ksi aging response. The new processes has also been found to be applicable to 3xxx (manganese based), 4xxx (silicon based), and 5xxx (magnesium based) aluminum alloys when such alloys include sufficient precipitatable solute to facilitate a 1 ksi aging response, and thus these alloys are also considered heat treatable for purposes of the present patent application. Other heat treatable aluminum alloy compositions may be employed.

In one embodiment, the heat treatable aluminum alloy comprises manganese (Mn) as an alloying element (i.e., not as an impurity). In these embodiments, and at least partially due to the high solidification rates, described above, the heat treatable aluminum alloy may include a sufficient amount manganese to facilitate solid solution strengthening. The amount of manganese useful for these purposes is generally alloy dependent. In one embodiment, the heat treatable aluminum alloy includes at least 0.05 wt. % Mn. In another embodiment, the heat treatable aluminum alloy includes at least 0.10 wt. % Mn. In yet embodiment, the heat treatable aluminum alloy includes at least 0.20 wt. % Mn. In another embodiment, the heat treatable aluminum alloy includes at least 0.25 wt. % Mn. In yet embodiment, the heat treatable aluminum alloy includes at least 0.30 wt. % Mn. In another embodiment, the heat treatable aluminum alloy includes at least 0.35 wt. % Mn. In another embodiment, the heat treatable aluminum alloy includes at least 0.40 wt. % Mn. In yet embodiment, the heat treatable aluminum alloy includes at least 0.45 wt. % Mn. In another embodiment, the heat treatable aluminum alloy includes at least 0.50 wt. % Mn. In yet embodiment, the heat treatable aluminum alloy includes at least 0.70 wt. % Mn. In another embodiment, the heat treatable aluminum alloy includes at least 1.0 wt. % Mn. In one embodiment, the heat treatable aluminum alloy includes not greater than 3.5 wt. % Mn. In another embodiment, the heat treatable aluminum alloy includes not greater than 3.0 wt. % Mn. In yet another embodiment, the heat treatable aluminum alloy includes not greater than 2.5 wt. % Mn. In another embodiment, the heat treatable aluminum alloy includes not greater than 2.0 wt. % Mn. In yet another embodiment, the heat treatable aluminum alloy includes not greater than 1.5 wt. % Mn. In one embodiment, the heat treatable aluminum alloy is substantially free of manganese, and includes less than 0.05 wt. % Mn. When a large amount of manganese is included in a heat treatable aluminum alloy, such a heat treatable aluminum alloy may be considered a 3xxx aluminum alloy.

In one approach, the heat treatable aluminum alloy includes at least one of magnesium, silicon and copper. In one embodiment, the heat treatable aluminum alloy includes at least magnesium and silicon, optionally with copper. In one embodiment, the heat treatable aluminum alloy includes at least all of magnesium, silicon and copper.

In one embodiment, the heat treatable aluminum alloy includes from 0.05 to 2.0 wt. % Mg. In one embodiment, the heat treatable aluminum alloy includes from 0.10 to 1.7 wt. % Mg. In one embodiment, the heat treatable aluminum alloy includes from 0.20 to 1.6 wt. % Mg. In any of these embodiments, the heat treatable aluminum alloy may include at least 0.75 wt. % Mg. More than the above-identified amounts of magnesium may be employed when the heat treatable aluminum alloy is a 5xxx aluminum alloy.

In one embodiment, the heat treatable aluminum alloy includes from 0.05 to 1.5 wt. % Si. In one embodiment, the heat treatable aluminum alloy includes from 0.10 to 1.4 wt. % Si. In one embodiment, the heat treatable aluminum alloy includes from 0.20 to 1.3 wt. % Si. More than the above-identified amounts of silicon may be employed when the heat treatable aluminum alloy is a 4xxx aluminum alloy.

In one embodiment, the heat treatable aluminum alloy includes from 0.05 to 2.0 wt. % Cu. In one embodiment, the heat treatable aluminum alloy includes from 0.10 to 1.7 wt. % Cu. In one embodiment, the heat treatable aluminum alloy includes from 0.20 to 1.5 wt. % Cu. More than the above-identified amounts of copper may be employed when the heat treatable aluminum alloy is a 2xxx aluminum alloy.

The heat treatable aluminum alloy may include silver and in amounts similar to that of copper. For example, the heat treatable aluminum alloy may optionally include up to 2.0 wt. % Ag. In one embodiment, the heat treatable aluminum alloy optionally includes up to 1.0 wt. % Ag. In another embodiment, the heat treatable aluminum alloy optionally includes up to 0.5 wt. % Ag. In yet another embodiment, the heat treatable aluminum alloy optionally includes up to 0.25 wt. % Ag. In embodiments where silver is included, the heat treatable aluminum alloy generally includes at least 0.05 wt. % Ag. In one embodiment, the heat treatable aluminum alloy is substantially free of silver, and includes less than 0.05 wt. % Ag. When a large amount of silver is included in a heat treatable aluminum alloy, such a heat treatable aluminum alloy may be considered a 8xxx aluminum alloy.

The heat treatable aluminum alloy may optionally include up to 2.0 wt. % Zn. In embodiments where zinc is included, the heat treatable aluminum alloy generally includes at least 0.05 wt. % Zn. In one embodiment, the heat treatable aluminum alloy includes not greater than 1.0 wt. % Zn. In another embodiment, the heat treatable aluminum alloy includes not greater than 0.5 wt. % Zn. In yet another embodiment, the heat treatable aluminum alloy includes not greater than 0.25 wt. % Zn. In another embodiment, the heat treatable aluminum alloy includes not greater than 0.10 wt. % Zn. In one embodiment, the heat treatable aluminum alloy is substantially free of zinc, and includes less than 0.05 wt. % Zn. More than the above-identified amounts of zinc may be employed when the heat treatable aluminum alloy is a 7xxx aluminum alloy.

The heat treatable aluminum alloy may optionally include up to 2.0 wt. % Fe. In embodiments where iron is included, the heat treatable aluminum alloy generally includes at least 0.05 wt. % Fe. In one embodiment, the heat treatable aluminum alloy optionally includes up to 1.5 wt. % Fe. In another embodiment, the heat treatable aluminum alloy optionally includes up to 1.25 wt. % Fe. In yet another embodiment, the heat treatable aluminum alloy optionally includes up to 1.00 wt. % Fe. In another embodiment, the heat treatable aluminum alloy optionally includes up to 0.80 wt. % Fe. In yet another embodiment, the heat treatable aluminum alloy optionally includes up to 0.50 wt. % Fe. In another embodiment, the heat treatable aluminum alloy optionally includes up to 0.35 wt. % Fe. In one embodiment, iron is present and the heat treatable aluminum alloy includes at least 0.08 wt. % Fe. In one embodiment, iron is present and the heat treatable aluminum alloy includes at least 0.10 wt. % Fe. In one embodiment, the heat treatable aluminum alloy is substantially free of iron, and includes less than 0.05 wt. % Fe. When a large amount of iron is included in a heat treatable aluminum alloy, such a heat treatable aluminum alloy may be considered a 8xxx aluminum alloy.

The heat treatable aluminum alloy may optionally include up to 1.0 wt. % of Cr. In embodiments where chromium is included, the heat treatable aluminum alloy generally includes at least 0.05 wt. % Cr. In one embodiment, the heat treatable aluminum alloy optionally includes up to 0.75 wt. % Cr. In another embodiment, the heat treatable aluminum alloy optionally includes up to 0.50 wt. % Cr. In yet another embodiment, the heat treatable aluminum alloy optionally includes up to 0.45 wt. % Cr. In another embodiment, the heat treatable aluminum alloy optionally includes up to 0.40 wt. % Cr. In yet another embodiment, the heat treatable aluminum alloy optionally includes up to 0.35 wt. % Cr. In one embodiment, chromium is present and the heat treatable aluminum alloy includes at least 0.08 wt. % Cr. In one embodiment, the heat treatable aluminum alloy is substantially free of chromium, and includes less than 0.05 wt. % Cr.

The heat treatable aluminum alloy may optionally include up to 0.50 wt. % Ti. In embodiments where titanium is included, the heat treatable aluminum alloy generally includes at least 0.001 wt. % Ti. In one embodiment, the heat treatable aluminum alloy optionally includes up to 0.25 wt. % Ti. In another embodiment, the heat treatable aluminum alloy optionally includes up to 0.10 wt. % Ti. In yet another embodiment, the heat treatable aluminum alloy optionally includes up to 0.05 wt. % Ti. In one embodiment, the heat treatable aluminum alloy includes from 0.01 to 0.05 wt. % Ti. In one embodiment, the heat treatable aluminum alloy is substantially free of titanium, and includes less than 0.001 wt. % Ti.

The heat treatable aluminum alloy may optionally include up to 0.50 wt. % each of any of Zr, Hf, Mo, V, In, Co and rare earth elements. In embodiments where at least one of Zr, Hf, Mo, V, In, Co and one or more rare earth elements is included, the heat treatable aluminum alloy generally includes at least 0.05 wt. % each of such one or more included elements. In one embodiment, the heat treatable aluminum alloy optionally includes up to 0.25 wt. % each of any of Zr, Hf, Mo, V, In, Co and rare earth elements. In another embodiment, the heat treatable aluminum alloy optionally includes up to 0.15 wt. % each of any of Zr, Hf, Mo, V, In, Co and rare earth elements. In yet another embodiment, the heat treatable aluminum alloy optionally includes up to 0.12 wt. % each of any of Zr, Hf, Mo, V, In, Co and rare earth elements. In one embodiment, the heat treatable aluminum alloy optionally includes from 0.05 to 0.20 wt. % each of at least one of Zr and V, and, in this embodiment is substantially free of Mo, V, In, Co and rare earth elements, i.e., the heat treatable aluminum alloy includes less than 0.05 wt. % each of all of Mo, V, In, Co and rare earth elements in this embodiment. In some embodiments, the heat treatable aluminum alloy is substantially free of all of Zr, Hf, Mo, V, In, Co and rare earth elements, and includes less than 0.05 wt. % each of all of Zr, Hf, Mo, V, In, Co and rare earth elements. The rare earth elements are scandium, yttrium, lanthanum, cerium, praseodymium, neodymium, promethium, samarium, europium, gadolinium, terbium, dysprosium, holmium, erbium, thulium, ytterbium, and lutetium.

The heat treatable aluminum alloy may optionally include up to 4.0 wt. % Ni. In embodiments where nickel is included, the heat treatable aluminum alloy generally includes at least 0.05 wt. % Ni. In one embodiment, the heat treatable aluminum alloy optionally includes up to 2.0 wt. % Ni. In another embodiment, the heat treatable aluminum alloy optionally includes up to 1.0 wt. % Ni. In yet another embodiment, the heat treatable aluminum alloy optionally includes up to 0.50 wt. % Ni. In one embodiment, the heat treatable aluminum alloy is substantially free of nickel, and includes less than 0.05 wt. % Ni. When a large amount of nickel is included in a heat treatable aluminum alloy, such a heat treatable aluminum alloy may be considered a 8xxx aluminum alloy.

The heat treatable aluminum alloy may optionally include up to 2.0 wt. % each of any of Sn, Bi, Pb, and Cd. In some embodiments, the heat treatable aluminum alloy is substantially free of all of Sn, Bi, Pb, and Cd, and includes less than 0.05 wt. % each of all of Sn, Bi, Pb, and Cd.

The heat treatable aluminum alloy may optionally include up to 1.0 wt. % each of any of Sr and Sb. In some embodiments, the heat treatable aluminum alloy is substantially free of all of Sn and Sb, and includes less than 0.05 wt. % each of Sr and Sb.

Aside from the above-listed elements, the balance (remainder) of the heat treatable aluminum alloy is generally aluminum and other elements, where the heat treatable aluminum alloy includes not greater than 0.15 wt. % each of these other elements, and where the total of these other elements does not exceed 0.35 wt. %. As used herein, "other elements" includes any elements of the periodic table other than the above-identified elements, i.e., any elements other than Al, Mn, Mg, Si, Cu, Ag, Zn, Fe, Cr, Ti, Zr, Hf, Mo, V, In, Co, rare earth elements, Ni, Sn, Bi, Pb, Cd, Sr and Sb. In one embodiment, the heat treatable aluminum alloy includes not greater than 0.10 wt. % each of other elements, and where the total of these other elements not exceeding 0.25 wt. %. In another embodiment, the heat treatable aluminum alloy includes not greater than 0.05 wt. % each of other elements, and where the total of these other elements not exceeding 0.15 wt. %. In yet another embodiment, the heat treatable aluminum alloy includes not greater than 0.03 wt. % each of other elements, and where the total of these other elements not exceeding 0.10 wt. %.

In one embodiment, the heat treatable aluminum alloy strip is used as a stock for containers (e.g., a food container; a beverage container), and, in these embodiments, the heat treatable aluminum alloy strip may include:

from 0.05 to 1.5 wt. % Si;
from 0.05 to 2.0 wt. % Cu;
from 0.05 to 2.0 wt. % Mg;
up to 3.5 wt. % Mn;
up to 1.5 wt. % Fe;
up to 1.0 wt. % Zn;
up to 0.30 wt. % Cr;
up to 0.25 wt. % Ti;
up to 0.25 wt. % each of any of Zr, Hf, Mo, V, In, Co and rare earth elements;
less than 0.05 wt. % each of all of Ag, Ni, Sn, Bi, Pb, Cd, Sr, and Sb;
the balance being aluminum and other elements, where the aluminum alloy includes not greater than 0.15 wt. % each of other elements, and where the total of these other elements not exceeding 0.35 wt. %.

In some of these embodiments, the heat treatable aluminum alloy container stock may include:

from 0.10 to 1.4 wt. % Si;
from 0.10 to 1.7 wt. % Cu;
from 0.10 to 1.7 wt. % Mg;
up to 2.0 wt. % Mn;
up to 0.8 wt. % Fe;
up to 0.5 wt. % Zn;
up to 0.25 wt. % Cr;
up to 0.10 wt. % Ti;
less than 0.15 wt. % each of all of Zr, Hf, Mo, V, In, Co and rare earth elements;
less than 0.05 wt. % each of all of Ag, Ni, Sn, Bi, Pb, Cd, Sr, and Sb;
the balance being aluminum and other elements, where the aluminum alloy includes not greater than 0.10 wt. % each of other elements, and where the total of these other elements not exceeding 0.25 wt. %.

In others of these embodiments, the heat treatable aluminum alloy container stock may include:

from 0.20 to 1.3 wt. % Si;
from 0.20 to 1.5 wt. % Cu;
from 0.20 to 1.6 wt. % Mg;
up to 1.5 wt. % Mn;
up to 0.5 wt. % Fe;
up to 0.25 wt. % Zn;
up to 0.25 wt. % Cr;
up to 0.05 wt. % Ti;
less than 0.15 wt. % each of all of Zr, Hf, Mo, V, In, Co and rare earth elements;
less than 0.05 wt. % each of all of Ag, Ni, Sn, Bi, Pb, Cd, Sr, and Sb;
the balance being aluminum and other elements, where the aluminum alloy includes not greater than 0.05 wt. % each of other elements, and where the total of these other elements not exceeding 0.15 wt. %.

In any of the above embodiments, the beverage stock heat treatable aluminum alloy strip may include at least 0.75 wt. % Mg. In any of the above embodiments, the beverage stock heat treatable aluminum alloy strip may include at least 0.05 wt. % Mn, or more, such as any of the manganese amounts described above. Additionally, any other amounts of the alloying elements described above may be used in conjunctions with any of the these container stock embodiments.

BRIEF DESCRIPTION OF THE DRAWINGS

FIGS. 12-1 and 12-2 are graphs illustrating results from Example 5.

DETAILED DESCRIPTION

Example 1

A heat treatable aluminum alloy having the composition in Table 1, below, is continuously cast, then hot rolled, then quenched, and then artificially aged in accordance with the new processes described herein.

TABLE 1

Composition of Ex. 1 Alloy (in wt. %)

| Si | Fe | Cu | Mn | Mg | Cr | Zn | Ti | Zr |
|---|---|---|---|---|---|---|---|---|
| 0.44 | 0.21 | 0.35 | 0.39 | 1.48 | 0.079 | 0.005 | 0.02 | 0 |

Figure 8:
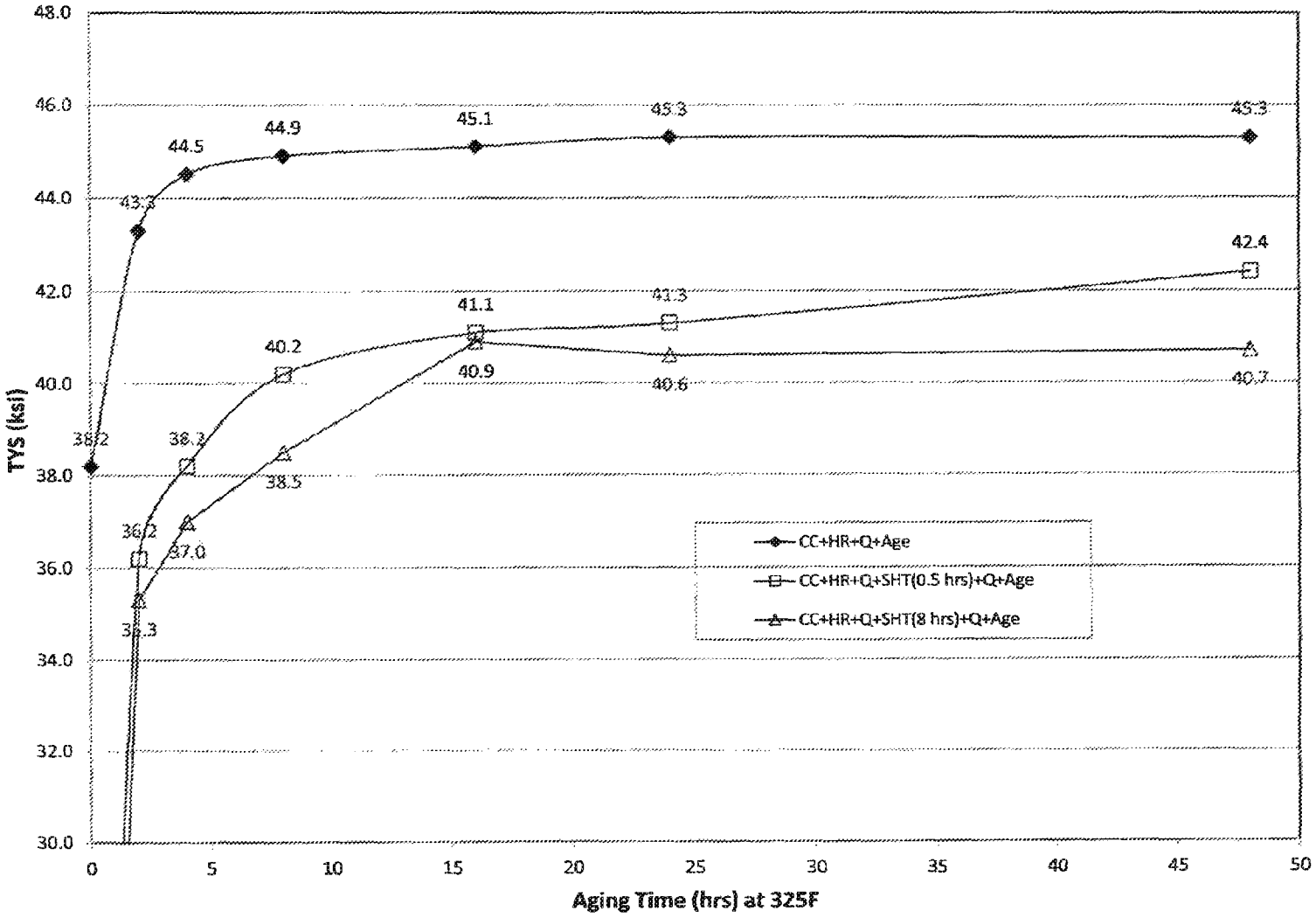
FIG. 8 is graph illustrating results from Example 1.

The remainder of the aluminum alloy was aluminum and other elements, where the aluminum alloy included not greater than 0.03 wt. % each of other elements, and where the total of these other elements not exceeding 0.10 wt. %. That same alloy is also continuously cast, then hot rolled, then quenched, and then solution heat treated (for 0.5 hours and also 8 hours), then quenched and then artificially aged. As shown in FIG. 8, the new process having no separate solution heat treatment step results in higher tensile yield strengths (about 10% higher) and with peak strength being reached sooner.

Example 2

Three heat treatable aluminum alloys were continuously cast, then hot rolled, then quenched, and then artificially aged in accordance with the new processes described herein. The compositions of these alloys are provided in Table 2, below.

TABLE 2

Composition of Ex. 2 Alloys (in wt. %)

| Alloy | Si | Fe | Cu | Mn | Mg | Zn | Ti |
|---|---|---|---|---|---|---|---|
| A | 0.29 | 0.26 | 0.20 | 1.08 | 0.81 | 0.04 | 0.017 |
| B | 0.29 | 0.69 | 0.20 | 0.73 | 0.80 | 0.01 | 0.015 |
| C | 0.49 | 0.49 | 0.41 | 0.89 | 1.1 | 0.01 | 0.034 |

The remainder of these aluminum alloys was aluminum and other elements, where the aluminum alloys included not greater than 0.03 wt. % each of other elements, and where the total of these other elements not exceeding 0.10 wt. %.

Figure 9:
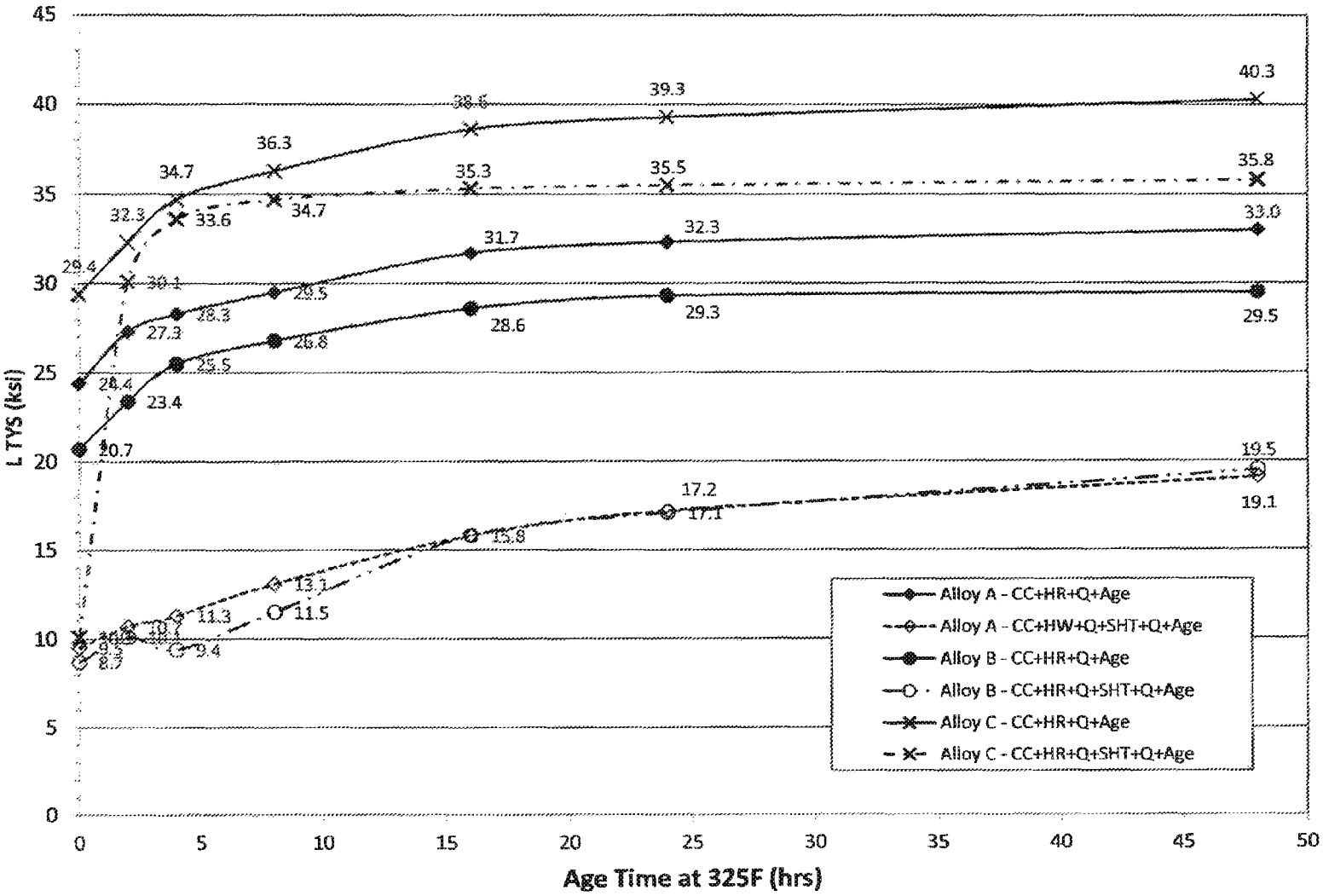
FIGS. 9-10 are graphs illustrating results from Example 2.
Figure 10:
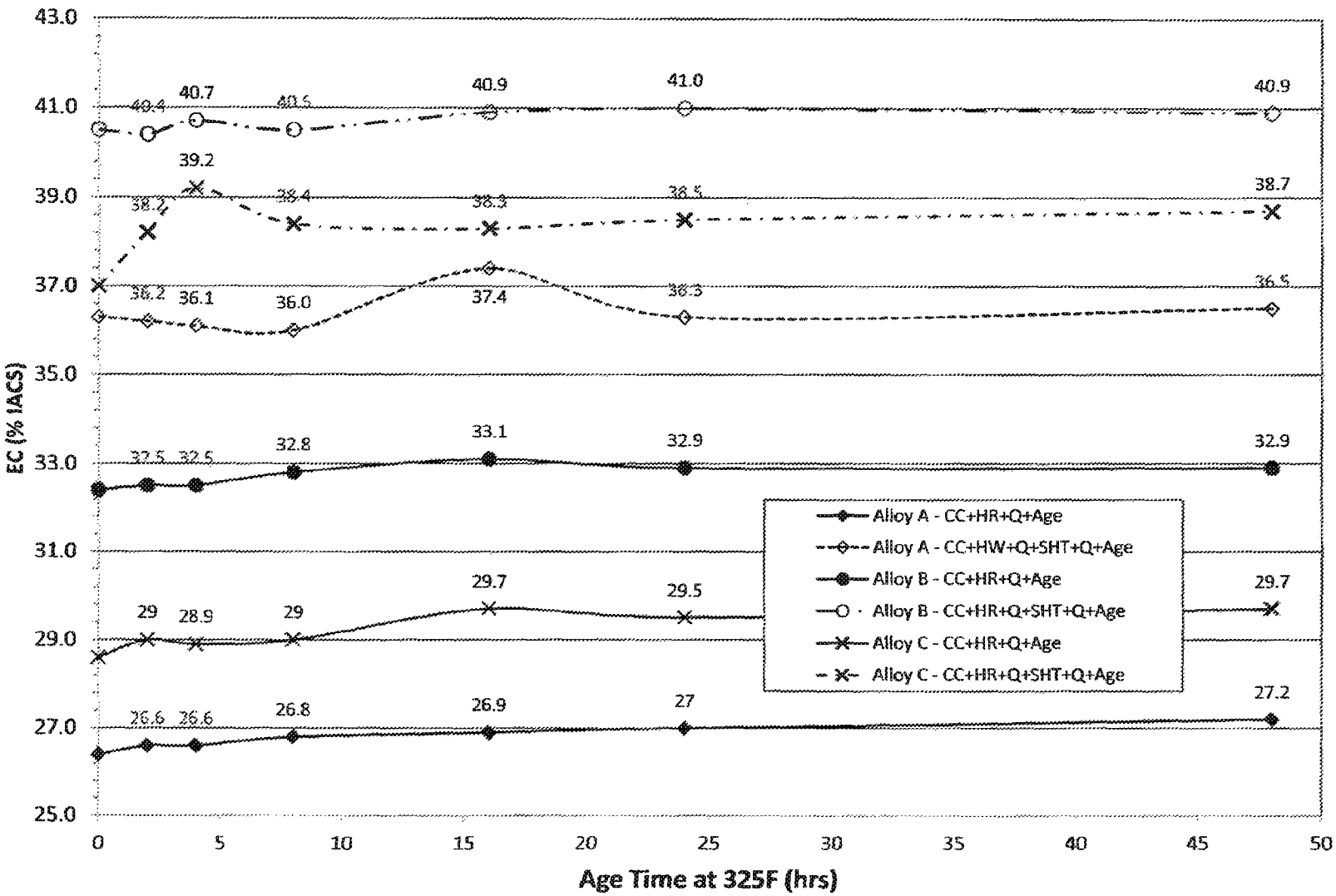

These same alloys were also continuously cast, then hot rolled, then quenched, and then solution heat treated (for 2 hours), then quenched and then artificially aged. As shown in FIG. 9, the new process having no separate solution heat treatment step results in higher yield strengths and with peak strength being reached sooner. The new heat treatable aluminum alloys also have lower electrical conductivity (EC), indicating that more alloying elements (such as manganese) have been retained in solid solution, as shown in FIG. 10. Indeed, the alloys made by the new process have from about 8.0 to about 10.0 lower EC values (units) (% IACS) as compared to the alloy processed by the conventional method. Stated differently, the conventionally processed alloys have from about 24% to about 36% higher electrical conductivity as compared to the alloys produced by the new process.

Example 3

Several heat treatable aluminum alloys were continuous cast to a thickness of about 0.100 inch. The alloys compositions are provided in Table 3, below.

TABLE 2

Composition of Ex. 3 Alloys (in wt. %)

| Alloy | Si | Fe | Cu | Mn | Mg | Ti | Zr |
|---|---|---|---|---|---|---|---|
| 1 | 0.39 | 0.28 | 0.39 | 0.73 | 0.77 | 0.037 | — |
| 2 | 0.20 | 0.27 | 0.42 | 0.72 | 0.80 | 0.035 | — |
| 3 | 0.39 | 0.28 | 0.20 | 0.74 | 1.18 | 0.032 | — |
| 4 | 0.22 | 0.29 | 0.28 | 0.76 | 0.81 | 0.023 | — |
| 5 | 0.41 | 0.29 | 0.42 | 0.30 | 1.17 | 0.025 | — |
| 6 | 0.21 | 0.28 | 0.21 | 0.68 | 1.19 | 0.024 | — |
| 7 | 0.20 | 0.27 | 0.43 | 0.31 | 0.80 | 0.024 | — |
| 8 | 0.20 | 0.27 | 0.21 | 0.31 | 1.20 | 0.020 | — |
| 9 | 0.38 | 0.26 | 0.21 | 0.30 | 0.79 | 0.018 | — |
| 10 | 0.41 | 0.27 | 0.42 | 0.78 | 1.19 | 0.022 | — |
| 11 | 0.22 | 0.28 | 0.45 | 0.29 | 1.21 | 0.013 | — |
| 12 | 0.30 | 0.27 | 0.31 | 0.49 | 0.99 | 0.031 | — |
| 13 | 0.30 | 0.21 | 0.31 | 0.51 | 1.01 | 0.027 | — |
| 14 | 0.30 | 0.36 | 0.30 | 0.50 | 0.99 | 0.026 | — |
| 15 | 0.30 | 0.59 | 0.31 | 0.52 | 0.99 | 0.029 | — |
| 16 | 0.30 | 0.28 | 1.47 | 1.51 | 1.48 | 0.029 | 0.11 |
| 17 | 0.39 | 0.30 | 1.47 | 0.97 | 1.50 | 0.021 | 0.11 |

The remainder of these aluminum alloys was aluminum and other elements, where the aluminum alloys included not greater than 0.03 wt. % each of other elements, and where the total of these other elements not exceeding 0.10 wt. %.

After continuously casting the alloys were immediately quenched as the alloys exit the casting apparatus. A first portion of these cast and quenched alloys was then aged, i.e., was processed in accordance with the new methods described herein where the heat treatable aluminum alloys were neither subsequently annealed nor subsequently solution heat treated. A second portion of the cast and quenched alloys was processed according to conventional methods in that the alloys were solution heat treated, and then quenched, and then aged. Both the first and the second portions were aged at 325° F. Mechanical properties of the alloys were obtained in the long-transverse direction (LT) in accordance with ASTM E8 and B557. Electrical conductivity results were obtained using a Hocking Auto Sigma 3000DL electrical conductivity meter. The results are provided in Tables 4-5, below.

TABLE 4

Properties (LT) of Ex. 3 alloys processed according to new methods ("N" alloys)

| Alloy | Aging | EC (% IACS) | TYS (ksi) | UTS (ksi) | Total El (%) |
|---|---|---|---|---|---|
| 1-N | None | 30.0 | 16.8 | 33.5 | 18.5 |
| | 325 F./2 hrs | 30.0 | 19.8 | 36.3 | 18.0 |
| | 325 F./4 hrs | 30.0 | 21.5 | 36.8 | 16.0 |
| | 325 F./8 hrs | 30.2 | 25.1 | 38.7 | 14.0 |
| | 325 F./16 hrs | 30.6 | 29.9 | 41.0 | 12.5 |
| | 325 F./24 hrs | 30.6 | 32.0 | 41.5 | 11.0 |
| 2-N | None | 30.1 | 13.0 | 28.1 | 26.0 |
| | 325 F./2 hrs | 30.0 | 15.2 | 30.9 | 25.0 |

TABLE 4-continued

Properties (LT) of Ex. 3 alloys processed according to new methods ("N" alloys)

| Alloy | Aging | EC (% IACS) | TYS (ksi) | UTS (ksi) | Total El (%) |
|---|---|---|---|---|---|
| | 325 F./4 hrs | 29.7 | 16.3 | 31.5 | 18.5 |
| | 325 F./8 hrs | 29.8 | 18.1 | 32.5 | 18.0 |
| | 325 F./16 hrs | 29.9 | 21.0 | 34.0 | 16.5 |
| | 325 F./24 hrs | 29.9 | 22.6 | 34.6 | 15.0 |
| 3-N | None | 29.0 | 18.0 | 30.7 | 17.5 |
| | 325 F./2 hrs | 28.8 | 20.1 | 34.5 | 16.0 |
| | 325 F./4 hrs | 28.8 | 21.3 | 36.0 | 16.0 |
| | 325 F./8 hrs | 28.8 | 22.8 | 36.5 | 16.0 |
| | 325 F./16 hrs | 28.8 | 24.7 | 37.8 | 14.5 |
| | 325 F./24 hrs | 28.9 | 26.0 | 38.5 | 12.0 |
| 4-N | None | 30.3 | 11.6 | 27.4 | 21.0 |
| | 325 F./2 hrs | 29.8 | 13.7 | 29.1 | 20.0 |
| | 325 F./4 hrs | 29.8 | 15.1 | 30.0 | 18.5 |
| | 325 F./8 hrs | 29.9 | 17.6 | 31.1 | 18.0 |
| | 325 F./16 hrs | 30.0 | 20.6 | 32.4 | 15.0 |
| | 325 F./24 hrs | 30.1 | 22.2 | 33.1 | 14.0 |
| 5-N | None | 34.5 | 18.2 | 35.4 | 20.5 |
| | 325 F./2 hrs | 34.2 | 22.3 | 38.5 | 18.5 |
| | 325 F./4 hrs | 34.5 | 23.8 | 39.1 | 17.5 |
| | 325 F./8 hrs | 34.7 | 25.4 | 40.1 | 16.5 |
| | 325 F./16 hrs | 34.6 | 27.8 | 41.2 | 14.5 |
| | 325 F./24 hrs | 34.7 | 29.5 | 42.1 | 13.0 |
| 6-N | None | 30.0 | 13.3 | 29.7 | 28.0 |
| | 325 F./2 hrs | 29.6 | 15.5 | 31.4 | 19.0 |
| | 325 F./4 hrs | 29.6 | 16.6 | 32.7 | 23.0 |
| | 325 F./8 hrs | 29.9 | 18.5 | 33.4 | 19.5 |
| | 325 F./16 hrs | 29.9 | 20.8 | 34.1 | 16.5 |
| | 325 F./24 hrs | 29.8 | 22.4 | 34.7 | 15.0 |
| 7-N | None | 37.6 | 11.9 | 28.1 | 26.5 |
| | 325 F./2 hrs | 37.3 | 15.8 | 31.8 | 23.5 |
| | 325 F./4 hrs | 37.2 | N/A | N/A | N/A |
| | 325 F./8 hrs | 37.1 | N/A | N/A | N/A |
| | 325 F./16 hrs | 37.3 | 23.4 | 35.8 | 18.5 |
| | 325 F./24 hrs | 37.7 | 25.2 | 36.6 | 16.5 |
| 8-N | None | 36.0 | 13.0 | 29.7 | 27.0 |
| | 325 F./2 hrs | 35.6 | 16.3 | 31.4 | 23.5 |
| | 325 F./4 hrs | 35.7 | 18.0 | 32.2 | 22.0 |
| | 325 F./8 hrs | 35.4 | 20.0 | 33.2 | 19.0 |
| | 325 F./16 hrs | 35.7 | 22.9 | 34.8 | 17.5 |
| | 325 F./24 hrs | 35.8 | 24.4 | 35.3 | 14.5 |
| 9-N | None | 36.6 | 16.7 | 33.0 | 22.0 |
| | 325 F./2 hrs | 36.3 | 19.3 | 34.9 | 22.0 |
| | 325 F./4 hrs | 36.3 | 21.2 | 36.2 | 20.0 |
| | 325 F./8 hrs | 36.3 | 24.4 | 37.8 | 18.5 |
| | 325 F./16 hrs | 36.8 | 29.2 | 39.8 | 15.0 |
| | 325 F./24 hrs | 37.1 | 31.8 | 40.9 | 13.5 |
| 10-N | None | 27.8 | 19.9 | 37.4 | 20.0 |
| | 325 F./2 hrs | 27.3 | 23.4 | 39.9 | 18.5 |
| | 325 F./4 hrs | 27.3 | 24.6 | 40.7 | 14.0 |
| | 325 F./8 hrs | 27.4 | 25.8 | 41.6 | 15.0 |
| | 325 F./16 hrs | 27.6 | 28.2 | 43.0 | 16.0 |
| | 325 F./24 hrs | 27.7 | 29.4 | 43.3 | 15.0 |
| 11-N | None | 35.9 | 13.1 | 31.3 | 27.0 |
| | 325 F./2 hrs | 35.6 | 18.1 | 34.9 | 24.0 |
| | 325 F./4 hrs | 35.7 | 19.3 | 35.5 | 23.0 |
| | 325 F./8 hrs | 35.5 | 21.1 | 36.2 | 19.5 |
| | 325 F./16 hrs | 35.7 | 23.7 | 37.6 | 19.0 |
| | 325 F./24 hrs | 35.9 | 25.5 | 38.7 | 18.0 |
| 12-N | None | 32.5 | 16.0 | 32.7 | 21.0 |
| | 325 F./2 hrs | 32.1 | 19.1 | 35.5 | 19.5 |
| | 325 F./4 hrs | 32.3 | 20.2 | 36.6 | 20.5 |
| | 325 F./8 hrs | 32.3 | 22.3 | 37.3 | 18.5 |
| | 325 F./16 hrs | 32.5 | 25.3 | 38.6 | 18.0 |
| | 325 F./24 hrs | 32.7 | 26.9 | 39.1 | 16.0 |
| 13-N | None | 32.6 | 15.7 | 33.2 | 25.0 |
| | 325 F./2 hrs | 32.2 | 19.4 | 35.5 | 21.5 |
| | 325 F./4 hrs | 32.3 | 20.5 | 35.8 | 19.0 |
| | 325 F./8 hrs | 32.4 | 22.2 | 37.2 | 18.0 |
| | 325 F./16 hrs | 32.5 | 24.6 | 38.2 | 17.0 |
| | 325 F./24 hrs | 32.7 | 26.3 | 39.0 | 16.0 |
| 14-N | None | 32.7 | 14.9 | 31.5 | 22.5 |
| | 325 F./2 hrs | 32.4 | 18.3 | 34.8 | 20.0 |
| | 325 F./4 hrs | 32.4 | 19.6 | 35.6 | 20.0 |
| | 325 F./8 hrs | 32.5 | 21.5 | 36.8 | 18.5 |

TABLE 4-continued

Properties (LT) of Ex. 3 alloys processed according to new methods ("N" alloys)

| Alloy | Aging | EC (% IACS) | TYS (ksi) | UTS (ksi) | Total El (%) |
|---|---|---|---|---|---|
| | 325 F./16 hrs | 32.7 | 24.6 | 38.2 | 17.0 |
| | 325 F./24 hrs | 32.7 | 26.7 | 39.3 | 15.0 |
| 15-N | None | 33.2 | 14.4 | 31.0 | 20.5 |
| | 325 F./2 hrs | 32.8 | 17.5 | 34.1 | 22.0 |
| | 325 F./4 hrs | 32.9 | 19.5 | 35.2 | 18.5 |
| | 325 F./8 hrs | 32.9 | 22.0 | 36.2 | 18.5 |
| | 325 F./16 hrs | 33.2 | 24.8 | 37.7 | 16.0 |
| | 325 F./24 hrs | 33.4 | 26.4 | 38.4 | 14.0 |
| 16-N | None | 21.7 | 23.6 | 43.4 | 14.5 |
| | 325 F./2 hrs | 21.4 | 29.7 | 46.5 | 12.0 |
| | 325 F./4 hrs | 21.3 | 30.7 | 48.0 | 11.5 |
| | 325 F./8 hrs | 21.4 | 31.5 | 47.8 | 11.0 |
| | 325 F./16 hrs | 21.4 | 32.6 | 48.9 | 10.5 |
| | 325 F./24 hrs | 21.5 | 33.1 | 48.6 | 9.5 |
| 17-N | None | 24.5 | 24.3 | 42.7 | 13.5 |
| | 325 F./2 hrs | 24.2 | 30.7 | 46.4 | 11.0 |
| | 325 F./4 hrs | 24.1 | 31.4 | 47.0 | 9.5 |
| | 325 F./8 hrs | 24.1 | 32.8 | 48.1 | 9.5 |
| | 325 F./16 hrs | 24.3 | 33.4 | 48.1 | 9.0 |
| | 325 F./24 hrs | 24.3 | 33.8 | 48.0 | 9.0 |

TABLE 5

Properties (LT) of Ex. 3 alloys processed according to conventional methods ("C" alloys)

| Alloy | Aging | EC (% IACS) | TYS (ksi) | UTS (ksi) | Total El (%) |
|---|---|---|---|---|---|
| 1-C | None | 39.3 | 11.2 | 26.4 | 21.0 |
| | 325 F./2 hrs | 39.3 | 24.4 | 36.8 | 15.5 |
| | 325 F./4 hrs | 39.4 | 29.5 | 39.7 | 12.0 |
| | 325 F./8 hrs | 39.5 | 32.8 | 41.6 | 11.5 |
| | 325 F./16 hrs | 39.8 | 33.6 | 42.0 | 12.0 |
| | 325 F./24 hrs | 40.2 | 34.0 | 42.3 | 12.0 |
| 2-C | None | 36.5 | 12.0 | 24.7 | 24.0 |
| | 325 F./2 hrs | 36.2 | 12.9 | 26.6 | 25.5 |
| | 325 F./4 hrs | 36.1 | 13.5 | 26.9 | 23.5 |
| | 325 F./8 hrs | 36.2 | 16.2 | 28.8 | 21.5 |
| | 325 F./16 hrs | 36.1 | 18.9 | 30.0 | 17.0 |
| | 325 F./24 hrs | 36.2 | 20.2 | 30.7 | 16.0 |
| 3-C | None | 37.3 | 13.1 | 27.6 | 24.0 |
| | 325 F./2 hrs | 37.3 | 28.4 | 29.2 | 12.0 |
| | 325 F./4 hrs | 37.1 | 32.6 | 41.5 | 9.5 |
| | 325 F./8 hrs | 37.3 | 30.9 | 40.7 | 10.5 |
| | 325 F./16 hrs | 37.5 | 33.6 | 42.0 | 9.5 |
| | 325 F./24 hrs | 37.4 | 34.2 | 42.2 | 10.0 |
| 4-C | None | 37.3 | 11.5 | 24.0 | 24.5 |
| | 325 F./2 hrs | 36.8 | 12.3 | 24.9 | 22.5 |
| | 325 F./4 hrs | 37.3 | 12.8 | 25.3 | 21.5 |
| | 325 F./8 hrs | 37.3 | 13.5 | 25.4 | 21.0 |
| | 325 F./16 hrs | 36.8 | 16.1 | 26.9 | 17.5 |
| | 325 F./24 hrs | 37.0 | 17.7 | 27.6 | 15.5 |
| 5-C | None | 40.5 | 11.3 | 27.9 | 24.5 |
| | 325 F./2 hrs | 40.2 | 35.8 | 47.2 | 14.5 |
| | 325 F./4 hrs | 39.9 | 36.2 | 47.6 | 14.0 |
| | 325 F./8 hrs | 40.1 | 38.7 | 48.9 | 14.0 |
| | 325 F./16 hrs | 40.3 | 39.4 | 49.1 | 14.0 |
| | 325 F./24 hrs | 40.0 | 40.3 | 49.2 | 11.5 |
| 6-C | None | 35.8 | 12.7 | 25.8 | 22.0 |
| | 325 F./2 hrs | 35.5 | 14.3 | 28.3 | 20.0 |
| | 325 F./4 hrs | 35.4 | 17.3 | 30.2 | 19.0 |
| | 325 F./8 hrs | 35.6 | 21.2 | 32.7 | 16.0 |
| | 325 F./16 hrs | 36.1 | 23.4 | 33.8 | 15.0 |
| | 325 F./24 hrs | 36.4 | 23.8 | 33.6 | 13.0 |
| 7-C | None | 42.2 | 10.0 | 23.3 | 28.5 |
| | 325 F./2 hrs | 41.7 | 15.5 | 28.8 | 26.5 |
| | 325 F./4 hrs | 42.0 | 19.5 | 31.6 | 20.0 |
| | 325 F./8 hrs | 42.3 | 24.2 | 34.4 | 16.5 |
| | 325 F./16 hrs | 42.6 | 26.6 | 35.5 | 14.0 |
| | 325 F./24 hrs | 42.6 | 27.3 | 35.9 | 13.5 |

TABLE 5-continued

Properties (LT) of Ex. 3 alloys processed according to conventional methods ("C" alloys)

| Alloy | Aging | EC (% IACS) | TYS (ksi) | UTS (ksi) | Total El (%) |
|---|---|---|---|---|---|
| 8-C | None | 40.3 | 10.2 | 24.9 | 28.0 |
| | 325 F./2 hrs | 40.0 | 19.8 | 32.1 | 19.5 |
| | 325 F./4 hrs | 40.2 | 23.6 | 34.7 | 17.0 |
| | 325 F./8 hrs | 40.3 | 26.8 | 36.6 | 15.0 |
| | 325 F./16 hrs | 40.4 | 27.8 | 37.1 | 14.0 |
| | 325 F./24 hrs | 40.3 | 28.3 | 37.3 | 13.0 |
| 9-C | None | 42.8 | 10.7 | 24.3 | 32.0 |
| | 325 F./2 hrs | 42.8 | 31.9 | 40.9 | 14.5 |
| | 325 F./4 hrs | 42.8 | 35.7 | 43.5 | 13.0 |
| | 325 F./8 hrs | 43.0 | 37.0 | 43.8 | 12.5 |
| | 325 F./16 hrs | 43.4 | 37.7 | 44.0 | 11.5 |
| | 325 F./24 hrs | 43.8 | 38.0 | 44.1 | 11.0 |
| 10-C | None | 36.8 | 13.7 | 30.1 | 26.5 |
| | 325 F./2 hrs | 36.6 | 30.7 | 43.8 | 16.0 |
| | 325 F./4 hrs | 36.6 | 33.3 | 45.3 | 15.0 |
| | 325 F./8 hrs | 36.6 | 35.0 | 46.3 | 15.5 |
| | 325 F./16 hrs | 36.8 | 35.6 | 46.3 | 13.5 |
| | 325 F./24 hrs | 36.9 | 35.8 | 46.6 | 13.0 |
| 11-C | None | 40.7 | 12.5 | 25.5 | 24.5 |
| | 325 F./2 hrs | 40.2 | 22.1 | 35.5 | 21.0 |
| | 325 F./4 hrs | 40.3 | 25.7 | 37.8 | 18.0 |
| | 325 F./8 hrs | 40.5 | 28.5 | 39.2 | 16.5 |
| | 325 F./16 hrs | 40.8 | 29.5 | 40.2 | 17.0 |
| | 325 F./24 hrs | 40.7 | 30.2 | 40.7 | 15.0 |
| 12-C | None | 39.3 | 10.7 | 25.7 | 27.0 |
| | 325 F./2 hrs | 38.8 | 24.0 | 36.3 | 19.0 |
| | 325 F./4 hrs | 39.6 | 28.1 | 38.6 | 15.0 |
| | 325 F./8 hrs | 39.6 | 30.9 | 40.1 | 13.0 |
| | 325 F./16 hrs | 39.9 | 32.2 | 40.8 | 13.0 |
| | 325 F./24 hrs | 39.6 | 32.2 | 40.8 | 13.0 |
| 13-C | None | 39.5 | 11.2 | 26.0 | 27.0 |
| | 325 F./2 hrs | 39.4 | 26.3 | 38.4 | 18.5 |
| | 325 F./4 hrs | 39.7 | 29.8 | 40.5 | 16.5 |
| | 325 F./8 hrs | 39.6 | 31.9 | 41.3 | 14.5 |
| | 325 F./16 hrs | 39.8 | 33.0 | 41.6 | 12.5 |
| | 325 F./24 hrs | 40.1 | 33.3 | 41.8 | 14.0 |
| 14-C | None | 39.5 | 10.6 | 25.8 | 25.0 |
| | 325 F./2 hrs | 38.8 | 22.4 | 35.1 | 17.5 |
| | 325 F./4 hrs | 39.2 | 26.7 | 38.3 | 17.5 |
| | 325 F./8 hrs | 39.3 | 29.5 | 39.7 | 14.0 |
| | 325 F./16 hrs | 39.9 | 31.0 | 40.3 | 13.0 |
| | 325 F./24 hrs | 40.0 | 31.2 | 40.5 | 13.5 |
| 15-C | None | 40.1 | 10.1 | 26.1 | 25.0 |
| | 325 F./2 hrs | 39.8 | 18.5 | 32.4 | 18.5 |
| | 325 F./4 hrs | 40.1 | 23.5 | 35.9 | 16.5 |
| | 325 F./8 hrs | 40.0 | 27.3 | 38.1 | 13.5 |
| | 325 F./16 hrs | 40.0 | 28.6 | 38.6 | 13.5 |
| | 325 F./24 hrs | 40.0 | 28.7 | 38.3 | 12.0 |
| 16-C | None | 27.7 | 15.4 | 39.1 | 17.0 |
| | 325 F./2 hrs | 26.2 | 29.5 | 49.5 | 13.0 |
| | 325 F./4 hrs | 26.2 | 30.3 | 50.8 | 15.5 |
| | 325 F./8 hrs | 26.3 | 31.0 | 51.0 | 14.5 |
| | 325 F./16 hrs | 26.5 | 31.9 | 50.8 | 15.0 |
| | 325 F./24 hrs | 26.8 | 32.3 | 50.9 | 13.5 |
| 17-C | None | 31.1 | 15.3 | 37.3 | 19.5 |
| | 325 F./2 hrs | 29.6 | 33.0 | 52.8 | 14.0 |
| | 325 F./4 hrs | 29.4 | 34.7 | 53.7 | 14.0 |
| | 325 F./8 hrs | 29.8 | 36.9 | 54.2 | 14.0 |
| | 325 F./16 hrs | 29.4 | 37.1 | 54.0 | 11.5 |
| | 325 F./24 hrs | 29.7 | 38.2 | 55.4 | 14.5 |

Table 6, below, compares the peak tensile yield strengths for each of alloys 1-17 as processed by the new process and the conventional process.

TABLE 6

Comparison between peak tensile yield strength of new alloys and conventional alloys

| Alloy | Peak TYS (LT) for "N" (New) alloys | Peak TYS for (LT) "C" (Convent.) alloys | DELTA (C minus N) |
|---|---|---|---|
| 1 | 32 | 34 | −2 |
| 2 | 22.6 | 20.2 | 2.4 |
| 3 | 26 | 34.2 | −8.2 |
| 4 | 22.2 | 17.7 | 4.5 |
| 5 | 29.5 | 40.3 | −10.8 |
| 6 | 22.4 | 23.8 | −1.4 |
| 7 | 25.2 | 27.3 | −2.1 |
| 8 | 24.4 | 28.3 | −3.9 |
| 9 | 31.8 | 38 | −6.2 |
| 10 | 29.4 | 35.8 | −6.4 |
| 11 | 25.5 | 30.2 | −4.7 |
| 12 | 26.9 | 32.2 | −5.3 |
| 13 | 26.3 | 33.3 | −7 |
| 14 | 26.7 | 31.2 | −4.5 |
| 15 | 26.4 | 28.7 | −2.3 |
| 16 | 33.1 | 32.3 | 0.8 |
| 17 | 33.8 | 38.2 | −4.4 |

As shown, the new alloys that have a high amount of Mn (e.g., 0.45 wt. % or higher) tend to achieve similar peak yield strengths relative to the conventionally processed materials.

For example, new alloys 2, 4 and 16 achieve similar or better peak yield strengths than their counterpart conventionally processed alloys. Alloys 2, 4 and 16 all have at least 0.71 wt. % Mn. In this regard, the conventionally processed alloys may have restricted the potential strengthening effect of Mn. Specifically, the Mn included in solid solution due to the continuous casting step may have been subsequently precipitated out of solid solution via the conventional solutionizing step, thereby preventing such Mn from acting as a strengthening agent during subsequent aging. Conversely, the newly processed alloys may harness the strengthening effect of Mn by excluding a solution heat treatment step (and by excluding an anneal step), thereby restricting (and sometimes avoiding) precipitation of Mn from solid solution.

New alloys 1, 6, 7, and 15 achieve peak yield strengths that are close to (within 3 ksi of) the peak yield strengths of the their counterpart conventional alloys. All of these alloys have at least 0.52 wt. % Mn, except alloy 7, which had 0.31 wt. % Mn. However, alloy 7 had lower amounts of Si and Mg, so the conventional solutionizing step appears to have been less beneficial due to less solute being available for placing back into solid solution via the conventional solutionizing step. Indeed, as the data shows, alloys that contain less solute (e.g., less Mg, Si and Cu) tend to benefit more from the new processes, potentially because less solute is available for placing back into solid solution after casting via a subsequent solutionizing step. Likewise, alloys that contain more solute tend to benefit more from the conventional processes, potentially because more solute is available for placing back into solid solution after casting via a subsequent solutionizing step. Furthermore, as shown in the data, when lower amounts of Mn are present, the conventional processing is less detrimental to strength, potentially because precipitating lower amounts of Mn will only marginally affect strengthening. However, as shown below, sufficient deformation in the form of hot rolling and/or cold rolling may facilitate further increases in strength in the alloys made by the new processes described herein.

Example 4

Several manganese-containing heat treatable aluminum alloys were continuous cast to a thickness of about 0.100 inch. The alloys compositions are provided in Table 7, below.

TABLE 7

| Composition of Ex. 4 Alloys (in wt. %) | | | | | | | |
|---|---|---|---|---|---|---|---|
| Alloy | Si | Fe | Cu | Mn | Mg | Cr | Ti |
| AA | 0.30 | 0.30 | 0.29 | 0.99 | 0.98 | — | 0.03 |
| BB | 0.30 | 0.28 | 0.30 | 1.7 | 0.97 | — | 0.02 |
| CC | 0.30 | 0.31 | 0.29 | 3.1 | 1.00 | — | 0.02 |
| DD | 0.29 | 0.30 | 0.29 | 1.01 | 0.99 | 0.25 | 0.02 |
| EE | 0.30 | 0.31 | 0.30 | 0.99 | 0.99 | 0.40 | 0.02 |

The remainder of these aluminum alloys was aluminum and other elements, where the aluminum alloys included not greater than 0.03 wt. % each of other elements, and where the total of these other elements not exceeding 0.10 wt. %. As shown, all alloys contain from about 1.0 wt. % Mn to 3.1 wt. % Mn. Alloys DD and EE also contain chromium.

After continuously casting the alloys were either immediately quenched as the alloys exit the casting apparatus. A first portion of these cast and quenched alloys was then aged, i.e., was processed in accordance with the new methods described herein where the heat treatable aluminum alloys were neither annealed nor solution heat treated. A second portion of the cast and quenched alloys was processed according to conventional methods in that the alloys were solution heat treated, and then quenched, and then aged. Both the first and second portions were aged at 325° F. Mechanical properties of the alloys were obtained in the longitudinal direction (L) in accordance with ASTM E8 and B557. Electrical conductivity results were obtained using a Hocking Auto Sigma 3000DL electrical conductivity meter. The results are provided in Tables 8-9, below.

TABLE 8

| Properties (L) of Ex. 4 alloys processed according to new methods ("N" alloys) | | | | | |
|---|---|---|---|---|---|
| Alloy | Aging | EC (% IACS) | TYS (ksi) | UTS (ksi) | Total El (%) |
| AA-N | None | 27.4 | 15.7 | 33.3 | 17.5 |
| | 325 F./2 hrs | 26.8 | 18.9 | 36.3 | 18.0 |
| | 325 F./4 hrs | 26.5 | 20.1 | 37.2 | 20.0 |
| | 325 F./8 hrs | 26.5 | 21.9 | 38.0 | 18.0 |
| | 325 F./16 hrs | 26.7 | 24.6 | 39.1 | 17.0 |
| | 325 F./24 hrs | 26.6 | 26.4 | 39.6 | 16.0 |
| BB-N | None | 22.0 | 15.2 | 33.6 | 16.5 |
| | 325 F./2 hrs | 21.4 | 18.2 | 36.4 | 19.0 |
| | 325 F./4 hrs | 21.1 | 19.2 | 36.4 | 15.5 |
| | 325 F./8 hrs | 21.1 | 21.1 | 37.3 | 15.5 |
| | 325 F./16 hrs | 21.1 | 24.1 | 38.7 | 14.5 |
| | 325 F./24 hrs | 21.1 | 25.5 | 39.0 | 13.0 |
| CC-N | None | 18.1 | 15.7 | 32.2 | 10.0 |
| | 325 F./2 hrs | 18.0 | 15.7 | 32.7 | 12.0 |
| | 325 F./4 hrs | 17.6 | 16.2 | 32.6 | 10.5 |
| | 325 F./8 hrs | 17.7 | 17.2 | 33.7 | 11.5 |
| | 325 F./16 hrs | 17.8 | 18.3 | 33.5 | 10.5 |
| | 325 F./24 hrs | 17.7 | 19.1 | 34.3 | 11.0 |
| DD-N | None | 24.2 | 16.0 | 33.3 | 18.0 |
| | 325 F./2 hrs | 23.8 | 18.5 | 35.1 | 18.0 |
| | 325 F./4 hrs | 23.7 | 19.5 | 35.8 | 17.0 |
| | 325 F./8 hrs | 23.6 | 21.5 | 37.4 | 17.5 |
| | 325 F./16 hrs | 23.5 | 23.0 | 36.8 | 15.0 |
| | 325 F./24 hrs | 23.6 | 25.0 | 39.0 | 15.0 |
| EE-N | None | 22.4 | 16.1 | 33.9 | 21.5 |
| | 325 F./2 hrs | 22.0 | 19.1 | 36.6 | 18.5 |
| | 325 F./4 hrs | 21.8 | 20.1 | 37.3 | 18.5 |
| | 325 F./8 hrs | 21.9 | 22.2 | 38.3 | 17.0 |
| | 325 F./16 hrs | 21.8 | 24.4 | 39.0 | 16.5 |
| | 325 F./24 hrs | 21.9 | 25.9 | 39.8 | 16.0 |

TABLE 9

| Properties (L) of Ex. 4 alloys processed according to conventional methods ("C" alloys) | | | | | |
|---|---|---|---|---|---|
| Alloy | Aging | EC (% IACS) | TYS (ksi) | UTS (ksi) | Total El (%) |
| AA-C | None | 36.4 | 11.8 | 27.4 | 21.5 |
| | 325 F./2 hrs | 35.2 | 14.5 | 29.8 | 19.5 |
| | 325 F./4 hrs | 35.0 | 18.1 | 32.9 | 21.0 |
| | 325 F./8 hrs | 35.3 | 22.0 | 34.4 | 2.0 |
| | 325 F./16 hrs | 35.9 | 24.5 | 35.3 | 15.0 |
| | 325 F./24 hrs | 35.9 | 24.5 | 35.4 | 13.5 |
| BB-C | None | 30.6 | 14.2 | 28.9 | 18.0 |
| | 325 F./2 hrs | 29.8 | 14.8 | 30.6 | 17.0 |
| | 325 F./4 hrs | 29.4 | 14.6 | 30.1 | 18.0 |
| | 325 F./8 hrs | 29.6 | 14.9 | 30.3 | 17.0 |
| | 325 F./16 hrs | 29.6 | 15.1 | 31.3 | 20.0 |
| | 325 F./24 hrs | 29.6 | 15.5 | 31.3 | 16.0 |
| CC-C | None | 26.5 | 14.0 | 30.6 | 13.5 |
| | 325 F./2 hrs | 25.7 | 13.7 | 30.4 | 11.0 |
| | 325 F./4 hrs | 25.6 | 15.4 | 31.3 | 11.0 |
| | 325 F./8 hrs | 25.6 | 16.4 | 31.9 | 11.0 |
| | 325 F./16 hrs | 25.5 | 16.9 | 32.0 | 10.0 |
| | 325 F./24 hrs | 25.7 | 17.7 | 32.4 | 8.5 |
| DD-C | None | 32.0 | 13.0 | 27.7 | 18.5 |
| | 325 F./2 hrs | 31.1 | 13.7 | 29.0 | 16.5 |
| | 325 F./4 hrs | 30.6 | 14.9 | 29.5 | 16.5 |
| | 325 F./8 hrs | 30.7 | 16.6 | 30.6 | 18.0 |
| | 325 F./16 hrs | 31.1 | 19.6 | 32.9 | 15.5 |
| | 325 F./24 hrs | 31.1 | 20.4 | 33.3 | 14.0 |
| EE-C | None | 29.9 | 15.0 | 29.1 | 14.5 |
| | 325 F./2 hrs | 29.8 | 15.1 | 30.4 | 16.0 |
| | 325 F./4 hrs | 29.0 | 15.3 | 30.4 | 15.5 |
| | 325 F./8 hrs | 29.1 | 17.0 | 31.2 | 15.0 |
| | 325 F./16 hrs | 29.4 | 19.7 | 33.0 | 20.0 |
| | 325 F./24 hrs | 29.3 | 21.4 | 34.3 | 20.0 |

Figure 11:
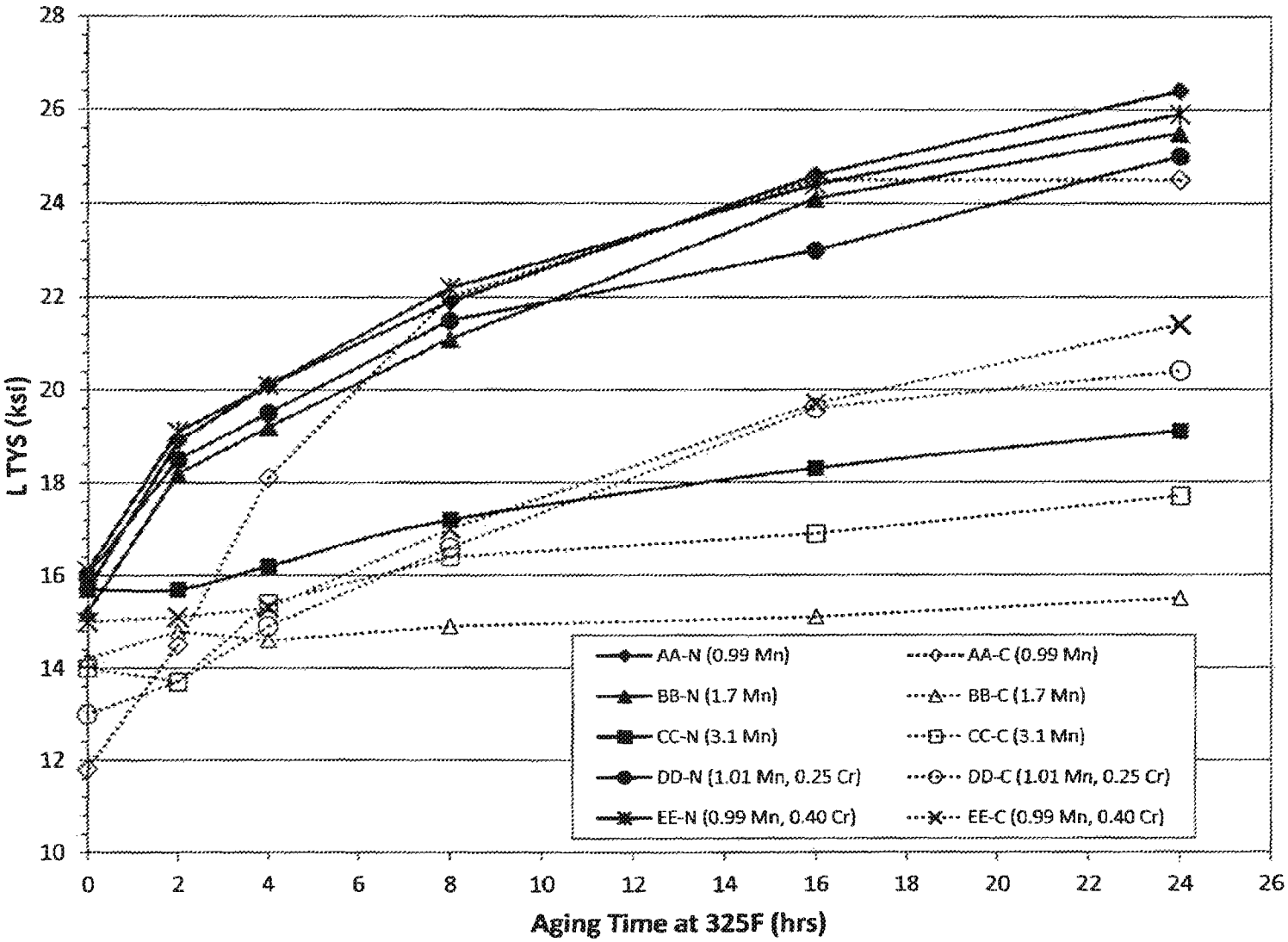
FIG. 11 is a graph illustrating results from Example 4.

As illustrated in FIG. 11, all of the new alloys achieve better peak yield strengths relative to the conventionally processed materials. These results indicate that Mn can facilitate improved properties in continuously cast heat treatable alloys and in amounts exceeding the 3.1 wt. % Mn of alloy CC (e.g., up to 3.5 wt. %). These results also indicate that the new heat treatable alloys may include up to 0.50 wt. % Cr, or more, and still realize improved results over conventionally processed alloys.

Example 5

Alloys AA-EE from Example 4 and three new alloys (FF-HH) were continuously cast, and then hot rolled about 30% (a reduction in thickness of about 30%) as the aluminum alloy strip exits the continuous casting apparatus, and then water quenched as the aluminum alloy strip exits the hot rolling apparatus. The compositions of alloys FF-HH are provided in Table 10, below.

TABLE 10

| Composition of Ex. 5 Alloys (in wt. %) | | | | | | |
|---|---|---|---|---|---|---|
| Alloy | Si | Fe | Cu | Mn | Mg | Ti |
| FF | 0.30 | 0.31 | 0.30 | 0.51 | 1.00 | 0.02 |
| GG | 0.28 | 0.29 | 0.31 | 0.06 | 0.97 | 0.01 |
| HH | 0.71 | 0.15 | 0.74 | 1.02 | 0.96 | 0.02 |

The remainder of these aluminum alloys was aluminum and other elements, where the aluminum alloys included not greater than 0.03 wt. % each of other elements, and where the total of these other elements not exceeding 0.10 wt. %.

A first portion of these cast, hot rolled, and quenched alloys was then aged, i.e., was processed in accordance with the new methods described herein where the heat treatable aluminum alloys were neither annealed nor solution heat treated. A second portion of these cast, hot rolled, and quenched alloys was processed according to conventional methods in that the alloys were solution heat treated, and then quenched, and then aged. Both the first and second portions were aged at 325° F. Mechanical properties of the alloys are obtained in the longitudinal direction (L) in accordance with ASTM E8 and B557. Electrical conductivity results were obtained using a Hocking Auto Sigma 3000DL electrical conductivity meter. The results are provided in Tables 11-12, below.

TABLE 11

Properties (L) of Ex. 5 alloys processed according to new methods ("N" alloys)

| Alloy | Approx. Gauge (in.) | Aging | EC (% IACS) | TYS (ksi) | UTS (ksi) | Total El (%) |
|---|---|---|---|---|---|---|
| AA-N-2 | 0.084 | None | 27.5 | 26.0 | 34.7 | 12.0 |
| | | 325F/2 hrs | 27.2 | 29.6 | 38.6 | 16.0 |
| | | 325F/4 hrs | 27.1 | 31.6 | 39.6 | 12.5 |
| | | 325F/8 hrs | 27.3 | 33.1 | 39.8 | 11.0 |
| | | 325F/16 hrs | 27.5 | 34.9 | 40.9 | 10.0 |
| | | 325F/24 hrs | 27.2 | 36.1 | 41.5 | 9.5 |
| BB-N-2 | 0.070 | None | 22.0 | 26.2 | 35.9 | 14.5 |
| | | 325F/2 hrs | 21.6 | 30.1 | 39.7 | 16.0 |
| | | 325F/4 hrs | 21.4 | 31.8 | 40.8 | 18.0 |
| | | 325F/8 hrs | 21.4 | 33.9 | 42.1 | 14.0 |
| | | 325F/16 hrs | 21.2 | 36.1 | 42.8 | 13.0 |
| | | 325F/24 hrs | 21.2 | 36.2 | 42.7 | 13.0 |
| CC-N-2 | 0.057 | None | 18.5 | 29.6 | 39.1 | 11.0 |
| | | 325F/2 hrs | 17.8 | 31.9 | 42.9 | 14.0 |
| | | 325F/4 hrs | 16.9 | 33.7 | 43.8 | 11.5 |
| | | 325F/8 hrs | 17.0 | 34.5 | 43.8 | 12.5 |
| | | 325F/16 hrs | 16.4 | 35.9 | 44.8 | 13.5 |
| | | 325F/24 hrs | 16.5 | 35.9 | 44.7 | 13.0 |
| DD-N-2 | 0.071 | None | 24.4 | 25.1 | 34.9 | 13.5 |
| | | 325F/2 hrs | 23.9 | 29.1 | 38.8 | 16.5 |
| | | 325F/4 hrs | 23.8 | 31.5 | 40.3 | 14.5 |
| | | 325F/8 hrs | 23.8 | 34.2 | 42.3 | 15.5 |
| | | 325F/16 hrs | 23.8 | 36.2 | 42.9 | 13.0 |
| | | 325F/24 hrs | 23.9 | 36.7 | 43.0 | 12.0 |
| EE-N-2 | 0.073 | None | 22.7 | 25.7 | 35.9 | 15.0 |
| | | 325F/2 hrs | 22.4 | 29.8 | 39.7 | 16.5 |
| | | 325F/4 hrs | 22.2 | 31.9 | 41.1 | 16.5 |
| | | 325F/8 hrs | 22.2 | 34.3 | 42.1 | 15.0 |
| | | 325F/16 hrs | 22.2 | 36.0 | 42.9 | 13.5 |
| | | 325F/24 hrs | 22.1 | 36.5 | 43.1 | 12.0 |
| FF-N-2 | 0.087 | None | 34.4 | 22.6 | 32.5 | 19.5 |
| | | 325F/2 hrs | 33.8 | 27.5 | 37.9 | 19.0 |
| | | 325F/4 hrs | 33.3 | 29.9 | 39.4 | 19.0 |
| | | 325F/8 hrs | 33.4 | 32.7 | 40.5 | 15.5 |
| | | 325F/16 hrs | 33.5 | 35.2 | 41.9 | 15.0 |
| | | 325F/24 hrs | 33.6 | 35.6 | 41.6 | 14.0 |
| GG-N-2 | 0.085 | None | 43.2 | 21.7 | 32.7 | 21.5 |
| | | 325F/2 hrs | 42.8 | 26.3 | 36.5 | 22.0 |
| | | 325F/4 hrs | 42.6 | 28.7 | 38.7 | 20.0 |
| | | 325F/8 hrs | 43.0 | 32.2 | 40.2 | 16.5 |
| | | 325F/16 hrs | 43.4 | 35.0 | 41.4 | 13.5 |
| | | 325F/24 hrs | 43.6 | 36.4 | 42.3 | 13.5 |
| HH-N-2 | 0.069 | None | 30.1 | 31.6 | 41.7 | 16.0 |
| | | 325F/2 hrs | 29.6 | 35.2 | 45.0 | 14.5 |
| | | 325F/4 hrs | 29.3 | 37.2 | 46.4 | 14.0 |
| | | 325F/8 hrs | 29.7 | 40.3 | 48.0 | 12.5 |
| | | 325F/16 hrs | 29.4 | 41.6 | 47.9 | 9.5 |
| | | 325F/24 hrs | 29.7 | 42.4 | 48.3 | 10.5 |

TABLE 12

Properties (L) of Ex. 5 alloys processed according to conventional methods ("C" alloys)

| Alloy | Approx. Gauge (in.) | Aging | EC (% IACS) | TYS (ksi) | UTS (ksi) | Total El (%) |
|---|---|---|---|---|---|---|
| AA-C-2 | ~0.084 | None | 36.3 | 13.3 | 27.1 | 22.5 |
| | | 325F/2 hrs | 35.4 | 14.4 | 29.0 | 18.5 |
| | | 325F/4 hrs | 35.3 | 17.5 | 31.6 | 17.5 |
| | | 325F/8 hrs | 35.5 | 22.2 | 34.1 | 14.0 |
| | | 325F/16 hrs | 35.4 | 25.2 | 36.2 | 12.5 |
| | | 325F/24 hrs | 35.5 | 24.8 | 36.1 | 17.5 |
| BB-C-2 | ~0.070 | None | 30.6 | 12.2 | 29.1 | 23.5 |
| | | 325F/2 hrs | 30.0 | 13.1 | 29.5 | 20.0 |
| | | 325F/4 hrs | 29.5 | 13.8 | 29.9 | 22.0 |
| | | 325F/8 hrs | 29.6 | 13.4 | 30.0 | 23.5 |
| | | 325F/16 hrs | 29.4 | 15.3 | 30.8 | 21.5 |
| | | 325F/24 hrs | 29.6 | 15.6 | 31.2 | 21.5 |
| CC-C-2 | ~0.057 | None | 28.6 | 13.2 | 32.0 | 25.0 |
| | | 325F/2 hrs | 28.2 | 14.8 | 33.6 | 20.0 |
| | | 325F/4 hrs | 27.4 | 14.3 | 33.0 | 18.5 |
| | | 325F/8 hrs | 27.9 | 16.1 | 33.7 | 21.0 |
| | | 325F/16 hrs | 27.7 | 18.1 | 35.1 | 17.5 |
| | | 325F/24 hrs | 27.5 | 19.4 | 35.2 | 16.5 |
| DD-C-2 | ~0.071 | None | 32.1 | 12.7 | 28.1 | 24.5 |
| | | 325F/2 hrs | 31.4 | 14.6 | 29.6 | 20.0 |
| | | 325F/4 hrs | 30.9 | 14.9 | 30.1 | 20.0 |
| | | 325F/8 hrs | 31.1 | 15.7 | 31.4 | 18.5 |
| | | 325F/16 hrs | 31.1 | 20.4 | 33.6 | 16.0 |
| | | 325F/24 hrs | 31.0 | 20.8 | 34.0 | 15.5 |
| EE-C-2 | ~0.073 | None | 31.6 | 14.2 | 29.8 | 21.0 |
| | | 325F/2 hrs | 31.2 | 17.1 | 31.5 | 18.0 |
| | | 325F/4 hrs | 30.7 | 16.9 | 31.5 | 19.0 |
| | | 325F/8 hrs | 30.7 | 18.9 | 32.9 | 19.0 |
| | | 325F/16 hrs | 31.2 | 21.9 | 35.1 | 17.0 |
| | | 325F/24 hrs | 31.2 | 22.2 | 34.6 | 17.0 |
| FF-C-2 | ~0.087 | None | 40.2 | 10.9 | 25.9 | 28.5 |
| | | 325F/2 hrs | 39.6 | 25.0 | 37.3 | 20.5 |
| | | 325F/4 hrs | 39.3 | 29.0 | 39.7 | 17.5 |
| | | 325F/8 hrs | 39.9 | 32.0 | 41.2 | 15.0 |
| | | 325F/16 hrs | 29.9 | 32.9 | 41.8 | 16.0 |
| | | 325F/24 hrs | 39.7 | 33.3 | 42.5 | 15.0 |
| GG-C-2 | ~0.085 | None | 46.5 | 10.6 | 24.0 | 28.0 |
| | | 325F/2 hrs | 45.6 | 29.7 | 40.2 | 17.5 |
| | | 325F/4 hrs | 45.4 | 33.1 | 42.2 | 16.0 |
| | | 325F/8 hrs | 45.5 | 35.0 | 43.7 | 15.0 |
| | | 325F/16 hrs | 45.6 | 35.8 | 44.4 | 15.0 |
| | | 325F/24 hrs | 45.6 | 36.7 | 44.8 | 15.0 |
| HH-C-2 | ~0.069 | None | 37.7 | 14.1 | 34.1 | 23.5 |
| | | 325F/2 hrs | 36.5 | 40.2 | 55.3 | 18.5 |
| | | 325F/4 hrs | 36.0 | 41.3 | 55.8 | 20.0 |
| | | 325F/8 hrs | 36.2 | 44.3 | 57.3 | 18.5 |
| | | 325F/16 hrs | 36.7 | 47.8 | 58.6 | 16.5 |
| | | 325F/24 hrs | 36.9 | 47.1 | 57.7 | 13.0 |

Figure 1:
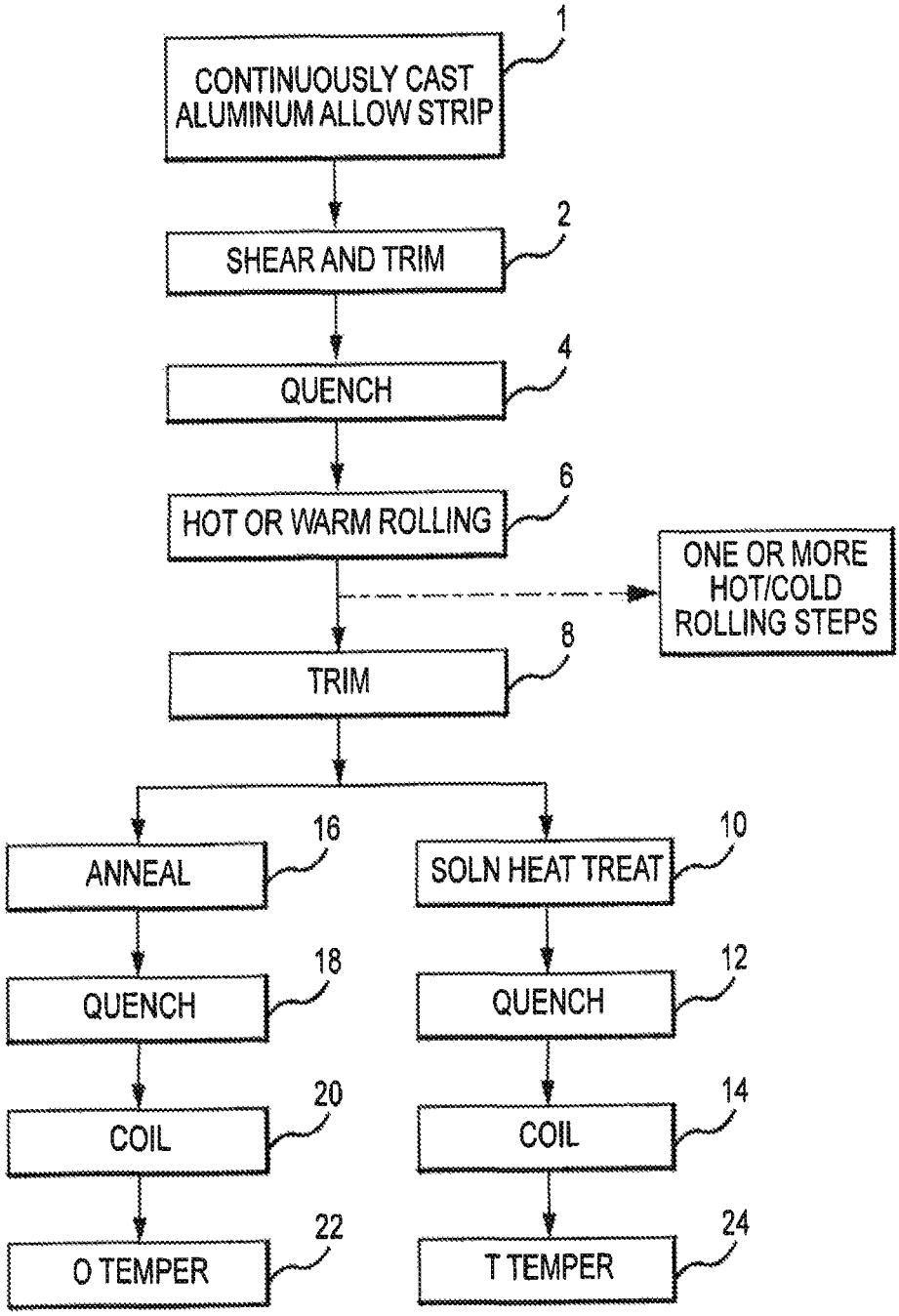
FIG. 1 is a flow chart from U.S. Pat. No. 7,182,825 illustrating one conventional process for producing continuously cast aluminum alloy products.
Figure 2:
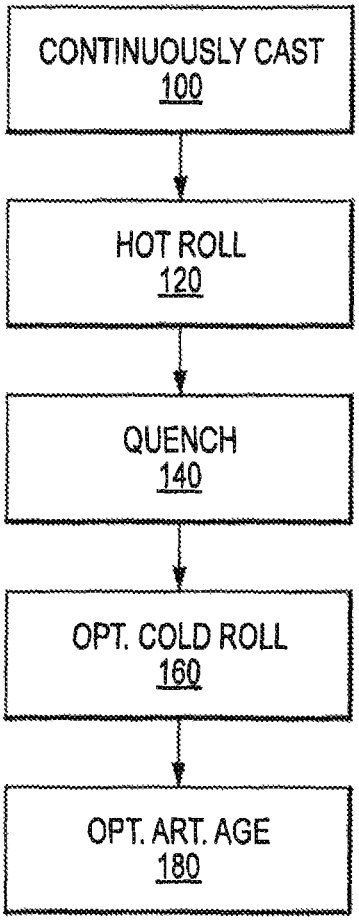
FIG. 2 is a flow chart illustrating one embodiment of a new process for producing continuously cast aluminum alloy products.
Figure 3:
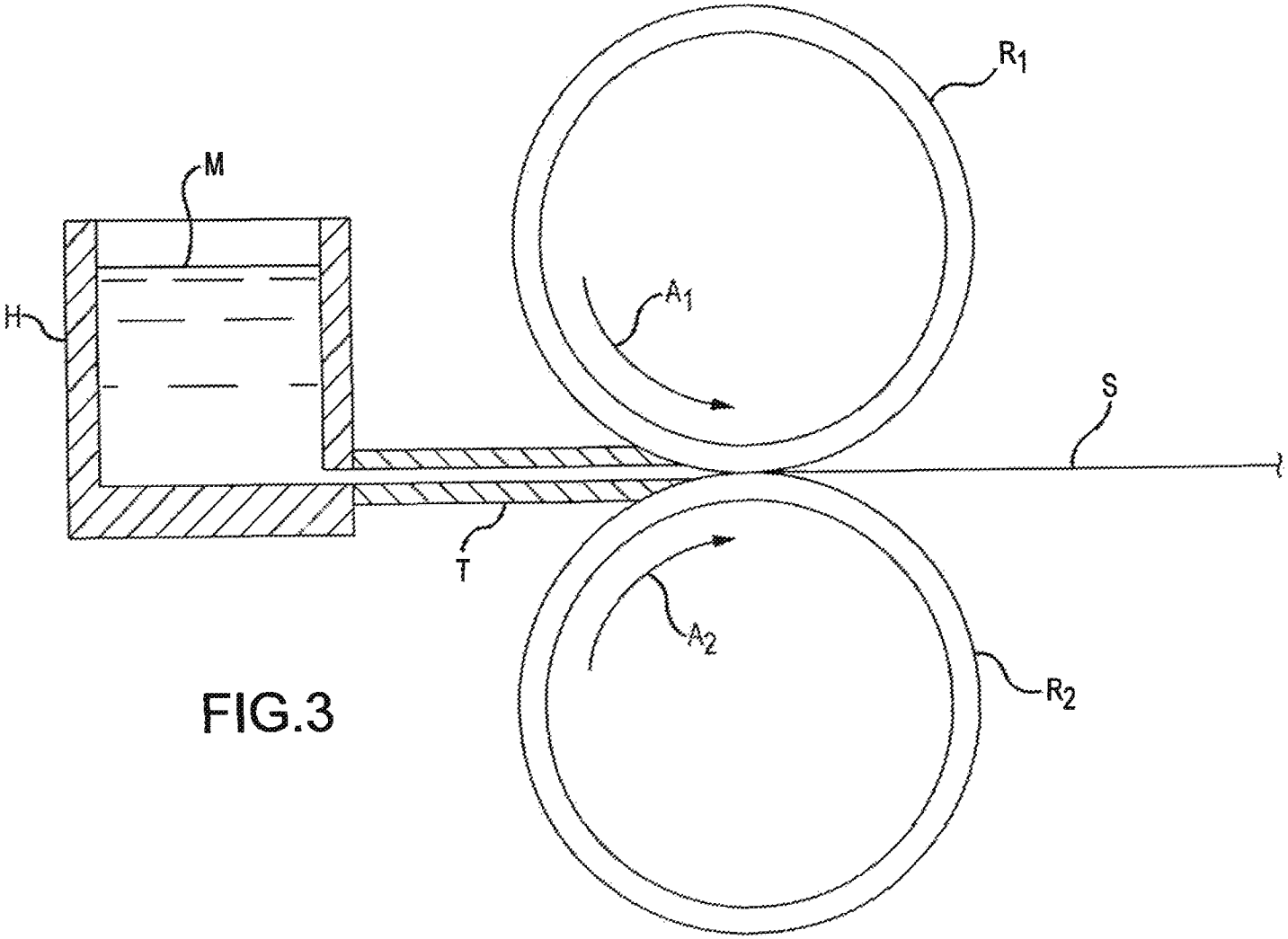
FIGS. 3-4 are schematic views illustrating one embodiment of continuous casting apparatus for continuously casting a strip and a corresponding strip microstructure.
Figure 4:
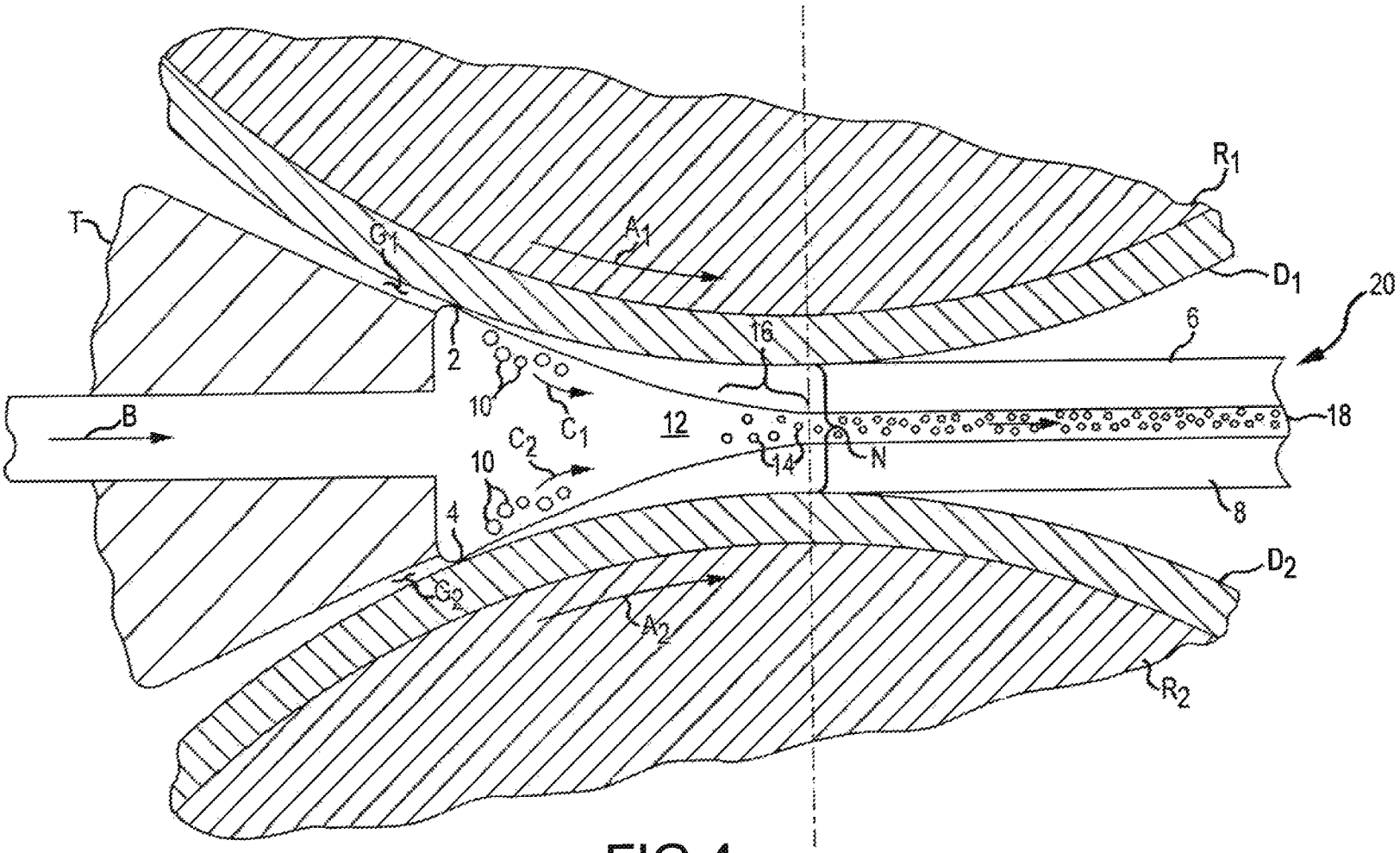
Figure 5:
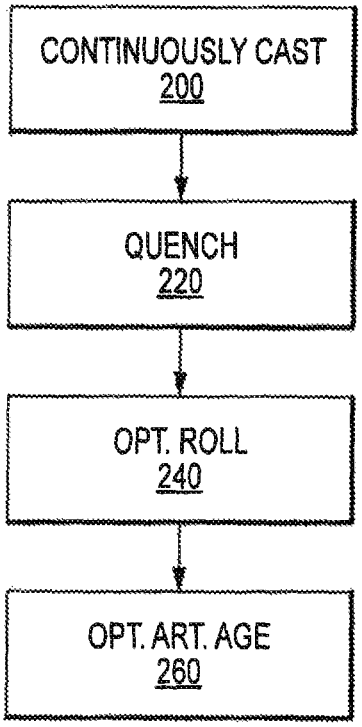
FIG. 5 is a flow chart illustrating another embodiment of a new process for producing continuously cast aluminum alloy products.
Figure 6:
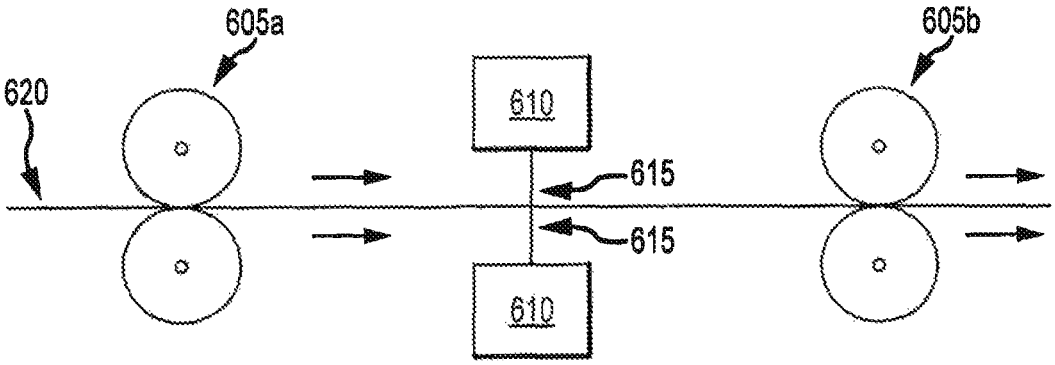
FIG. 6 is schematic view of one embodiment of a quenching arrangement useful in accordance with the new processes disclosed herein.
Figure 7:
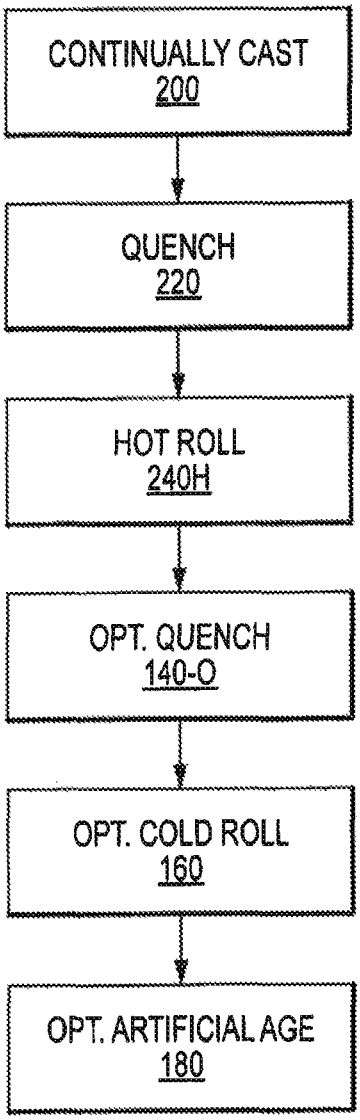
FIG. 7 is a flow chart illustrating another embodiment of a new process for producing continuously cast aluminum alloy products.
Figures 1, 12:
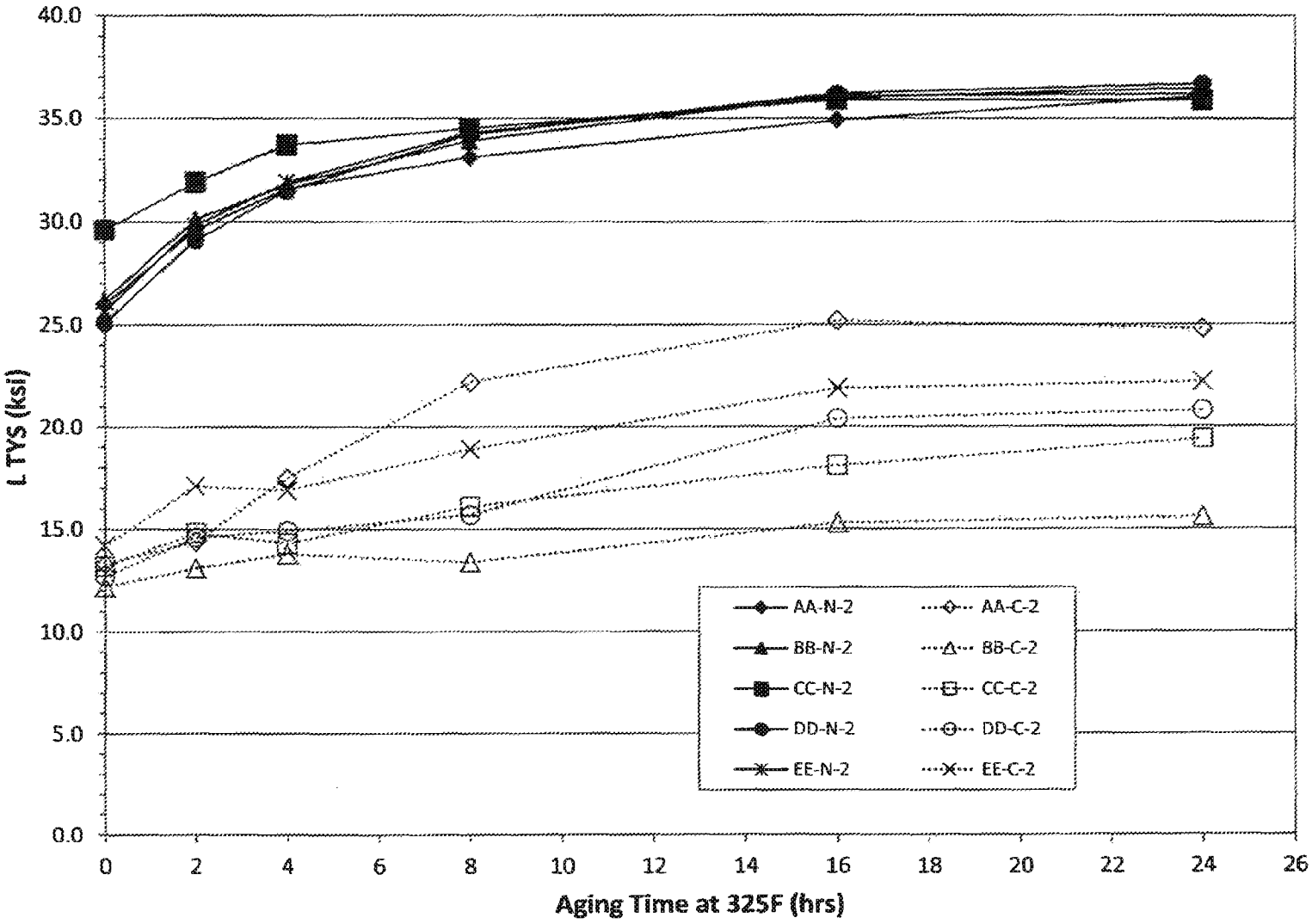
Figures 2, 12:
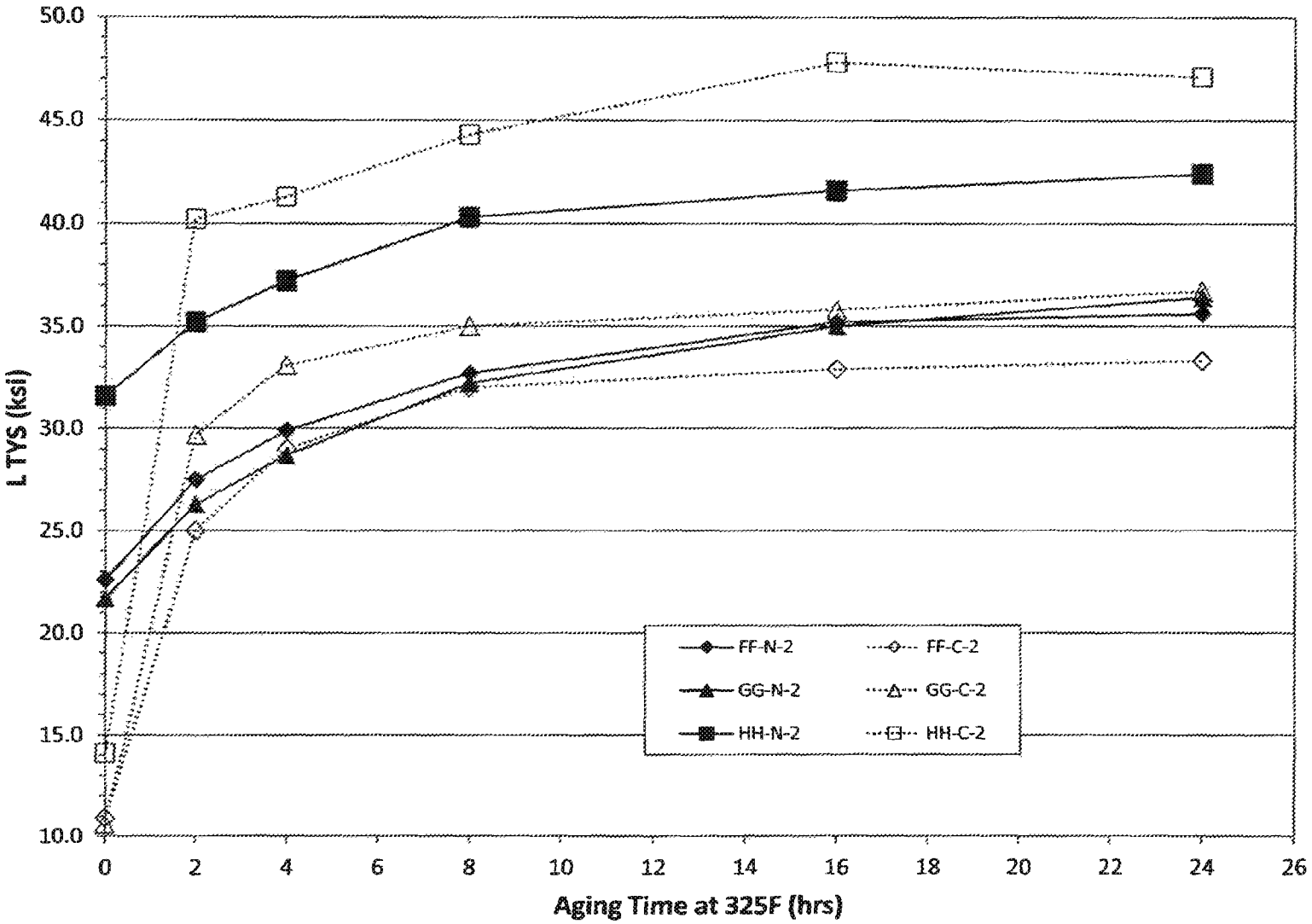

As illustrated in FIGS. 12-1 and 12-2, all of the new alloys achieve comparable or better peak yield strengths relative to the conventionally processed materials, except for alloy HH. Indeed, alloys AA-EE having about 1.0 wt. % Mn or more achieved superior results over their conventional counterpart alloys, achieving higher peak tensile yield strengths over their conventional counterpart alloys. Alloy FF having 0.51 wt. % Mn also achieved superior results over its conventional counterpart alloy achieving a peak tensile yield strength of 35.6 ksi as compared to its conventional counterpart alloy's peak tensile yield strength of 33.3 ksi. Even new alloy GG having 0.06 wt. % Mn achieved comparable results to its conventional counterpart alloy, achieving a peak tensile yield strength of 36.4 ksi as compared to its conventional counterpart alloy's peak tensile yield strength of 36.7 ksi. Only new alloy HH, having more solute (more Si, Mg, and Cu) did not achieve a peak tensile yield strength within 3 ksi of its conventional counterpart alloy. As noted in Example 3 above, alloys that contain less solute (e.g., Mg, Si and Cu) tend to benefit more from the new processes, potentially because less solute is available for placing back into solid solution after casting via a subsequent solutionizing step. Likewise, alloys that contain more solute tend to benefit more from the conventional processes, potentially because more solute is available for placing back into solid solution after casting via a subsequent solutionizing step. However, as shown below, in the new process imparting more work prior to quenching may facilitate achievement of higher strength and results comparable to that achieved by the prior conventional process.

Example 6

Alloy HH of Example 5 was produced as per Example 5, but was hot rolled about 60% (a reduction in thickness of about 60%) to a gauge of about 0.040 inch as the aluminum alloy strip exits the continuous casting apparatus, and then water quenched as the aluminum alloy strip exits the hot rolling apparatus. A first portion of this HH-60% alloy was processed in accordance with the new methods described herein where alloy HH-60% was neither annealed nor solution heat treated. A second portion of alloy HH-60% was processed according to conventional methods in that it was solution heat treated, and then quenched, and then aged. Both the first and second portions were aged at 325° F. Mechanical properties were obtained in in the longitudinal direction (L) in accordance with ASTM E8 and B557. Electrical conductivity results were obtained using a Hocking Auto Sigma 3000DL electrical conductivity meter. The results are provided in Table 13, below.

TABLE 13

Properties (L) of Ex. 6 alloys processed according to new ("N" alloys) and conventional ("C" alloys) methods

| Alloy | Aging | EC (% IACS) | TYS (ksi) | UTS (ksi) | Total El (%) |
|---|---|---|---|---|---|
| HH60%-N | None | 30.7 | 36.8 | 42.4 | 8.0 |
| | 325 F./2 hrs | 30.3 | 41.2 | 46.0 | 7.5 |
| | 325 F./4 hrs | 29.5 | 42.4 | 46.6 | 7.0 |
| | 325 F./8 hrs | 30.1 | 43.9 | 47.7 | 7.0 |
| | 325 F./16 hrs | 30.0 | 43.8 | 47.2 | 6.0 |
| | 325 F./24 hrs | 29.3 | 47.4 | 49.7 | 6.0 |
| HH60%-C | None | 37.3 | — | 31.8 | 18.0 |
| | 325 F./2 hrs | 36.9 | 40.0 | 53.1 | 13.0 |
| | 325 F./4 hrs | 36.3 | 41.5 | 54.3 | 14.5 |
| | 325 F./8 hrs | 36.4 | 43.9 | 54.9 | 14.0 |
| | 325 F./16 hrs | 36.9 | 45.7 | 55.7 | 12.0 |
| | 325 F./24 hrs | 37.1 | 41.4 | 51.0 | 11.0 |

As shown in Table 13, alloy HH-60%-N (using the new process) achieved superior results over its conventional counterpart alloy achieving a peak tensile yield strength of 47.4 ksi as compared to its conventional counterpart alloy's peak tensile yield strength of 45.7 ksi. These results indicate that, even in heat treatable alloys having higher amounts of solute, the new process can achieve comparable or superior results to the conventional process.

Example 7

Three alloys were continuously cast, then hot rolled about 40% (a reduction in thickness of about 40%) to a gauge of about 0.085 inch as the alloy exits the continuous casting apparatus, and then water quenched as the aluminum alloy strip exits the hot rolling apparatus. The compositions of these alloys are provided in Table 14, below.

TABLE 14

Composition of Ex. 7 Alloys (in wt. %)

| Alloy | Si | Fe | Cu | Mn | Mg | Ti |
|---|---|---|---|---|---|---|
| 18 | 1.30 | 0.13 | 1.150 | 0.05 | 0.27 | 0.04 |
| 19 | 1.27 | 0.13 | 0.856 | 0.08 | 0.13 | 0.03 |
| 20 | 1.30 | 0.13 | 0.878 | 0.05 | 0.22 | 0.03 |

The remainder of these aluminum alloys was aluminum and other elements, where the aluminum alloys included not greater than 0.03 wt. % each of other elements, and where the total of these other elements not exceeding 0.10 wt. %.

A first portion of these cast, hot rolled, and quenched alloys was then aged, i.e., was processed in accordance with the new methods described herein where the heat treatable aluminum alloys were neither annealed nor solution heat treated. A second portion of these cast, hot rolled, and quenched alloys was processed according to conventional methods in that the alloys were solution heat treated, and then quenched, and then aged. Both the first and second portions were aged at 325° F. Mechanical properties of the alloys are obtained in the longitudinal direction (LT) in accordance with ASTM E8 and B557. Electrical conductivity results were obtained using a Hocking Auto Sigma 3000DL electrical conductivity meter. results are provided in Tables 15-16, below.

TABLE 15

Properties (LT) of Ex. 7 alloys processed according to new methods ("N" alloys)

| Alloy | Aging | EC (% IACS) | TYS (ksi) | UTS (ksi) | Total El (%) |
|---|---|---|---|---|---|
| 18-N | None | 41.6 | 22.9 | 36.6 | 17.5 |
| | 325 F./2 hrs | 43.7 | 30.2 | 41.8 | 17.5 |
| | 325 F./4 hrs | 44.6 | 33.2 | 43.5 | 14.0 |
| | 325 F./8 hrs | 46.6 | 34.1 | 43.6 | 12.0 |
| | 325 F./16 hrs | 49.4 | 33.1 | 42.5 | 12.0 |
| | 325 F./24 hrs | 50.6 | 30.4 | 39.3 | 10.5 |
| 19-N | None | 41.4 | 15.2 | 31.8 | 28.5 |
| | 325 F./2 hrs | 42.5 | 19.0 | 32.7 | 22.5 |
| | 325 F./4 hrs | 43.2 | 23.6 | 36.4 | 19.0 |
| | 325 F./8 hrs | 44.6 | 27.2 | 38.6 | 14.0 |
| | 325 F./16 hrs | 47.9 | 26.9 | 37.6 | 13.0 |
| | 325 F./24 hrs | 49.6 | 24.5 | 34.8 | 12.0 |
| 20-N | None | 42.6 | 21.5 | 35.3 | 26.5 |
| | 325 F./2 hrs | 44.9 | 29.5 | 40.2 | 17.5 |
| | 325 F./4 hrs | 46.0 | 32.6 | 42.5 | 14.5 |
| | 325 F./8 hrs | 47.2 | 33.0 | 42.3 | 12.5 |
| | 325 F./16 hrs | 50.3 | 32.1 | 41.3 | 11.5 |
| | 325 F./24 hrs | 51.3 | 29.5 | 38.2 | 12.0 |

TABLE 16

Properties (LT) of Ex. 7 alloys processed according to conventional methods ("C" alloys)

| Alloy | Aging | EC (% IACS) | TYS (ksi) | UTS (ksi) | Total El (%) |
|---|---|---|---|---|---|
| 18-C | None | 41.6 | 13.4 | 33.6 | 33.0 |
| | 325 F./2 hrs | 41.7 | 30.9 | 47.5 | 24.0 |
| | 325 F./4 hrs | 41.4 | 32.2 | 47.7 | 22.0 |
| | 325 F./8 hrs | 41.0 | 34.9 | 48.6 | 19.0 |
| | 325 F./16 hrs | 43.9 | 36.1 | 48.8 | 17.5 |
| | 325 F./24 hrs | 44.9 | 37.5 | 49.2 | 15.5 |
| 19-C | None | 43.3 | 9.7 | 25.0 | 31.0 |
| | 325 F./2 hrs | 42.9 | 24.3 | 37.4 | 19.0 |
| | 325 F./4 hrs | 43.0 | 25.3 | 37.9 | 21.0 |
| | 325 F./8 hrs | 43.5 | 27.2 | 39.1 | 17.5 |

TABLE 16-continued

Properties (LT) of Ex. 7 alloys processed according to conventional methods ("C" alloys)

| Alloy | Aging | EC (% IACS) | TYS (ksi) | UTS (ksi) | Total El (%) |
|---|---|---|---|---|---|
| | 325 F./16 hrs | 47.4 | 28.3 | 39.7 | 15.0 |
| | 325 F./24 hrs | 49.8 | 28.4 | 39.4 | 14.5 |
| 20-C | None | 42.6 | 10.5 | 29.0 | 28.5 |
| | 325 F./2 hrs | 43.0 | 29.9 | 44.0 | 22.0 |
| | 325 F./4 hrs | 42.7 | 31.0 | 44.2 | 21.0 |
| | 325 F./8 hrs | 42.6 | 32.3 | 45.0 | 20.0 |
| | 325 F./16 hrs | 45.5 | 33.5 | 45.2 | 17.0 |
| | 325 F./24 hrs | 47.4 | 34.0 | 45.4 | 15.5 |

Figure 13:
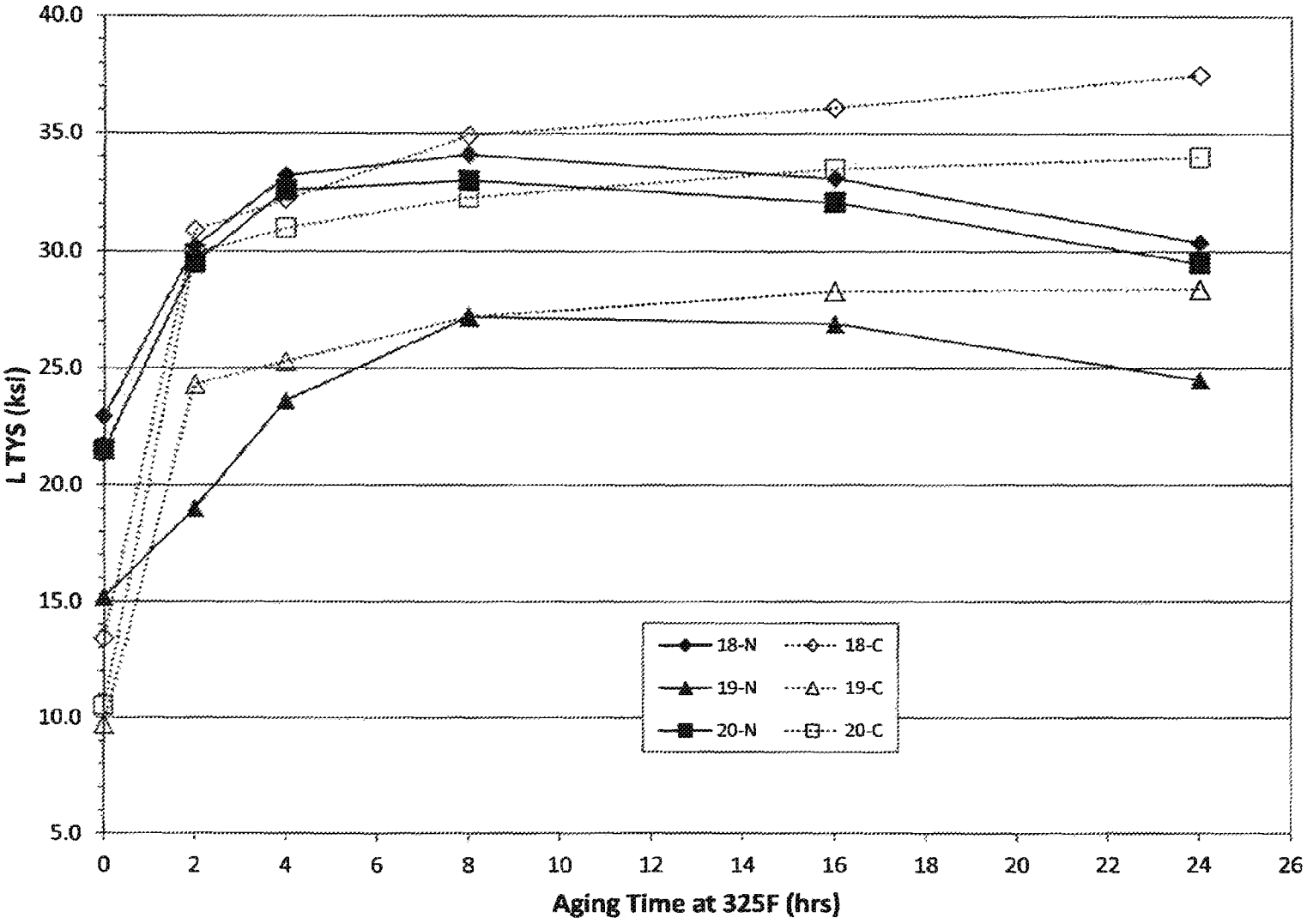
FIG. 13 is a graph illustrating results of Example 7.
Figure 14:
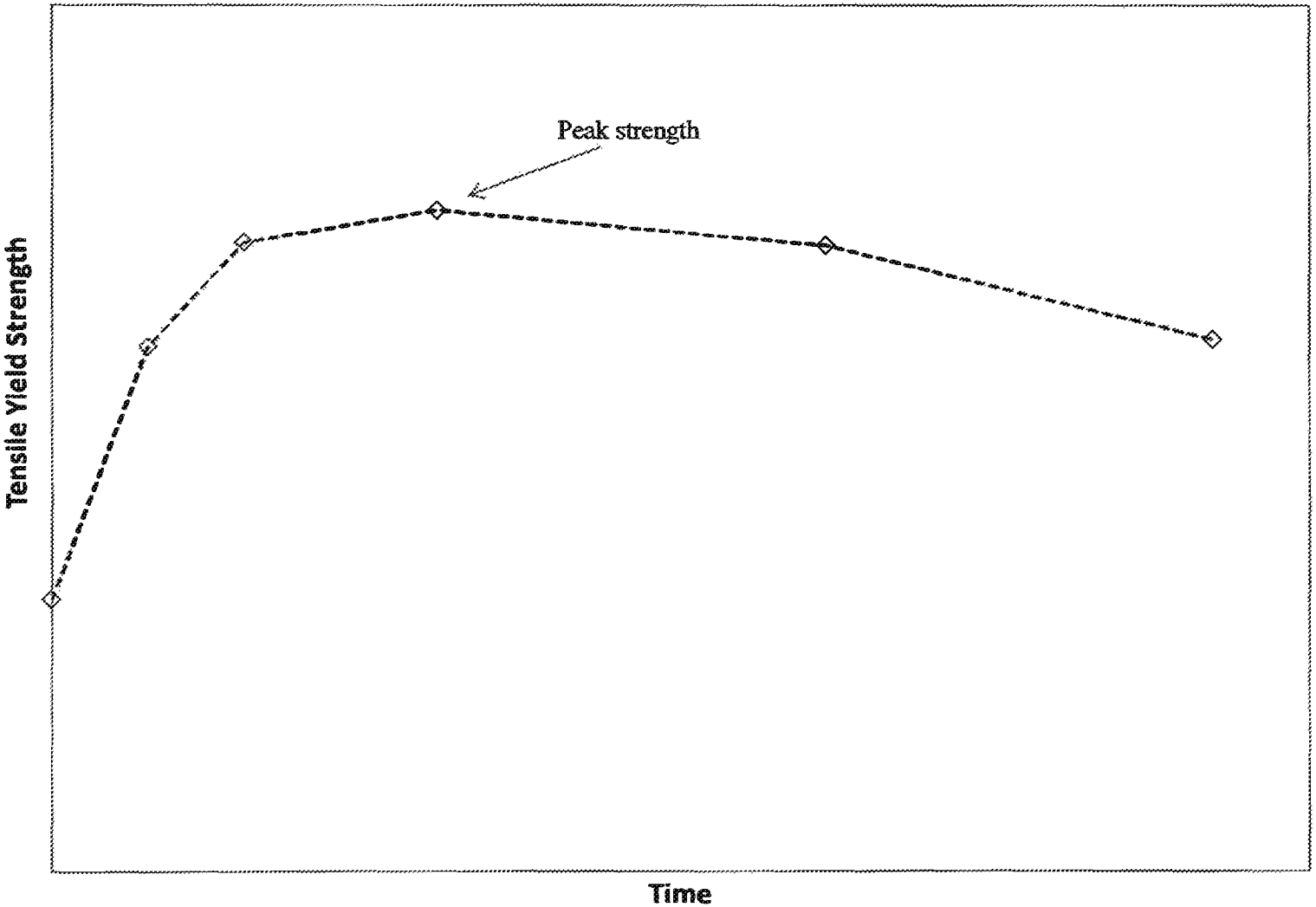
FIG. 14 is an example graph showing an example of an aging curve appropriate for determining a peak longitudinal (L) tensile yield strength of an aluminum alloy strip.
Figure 15:
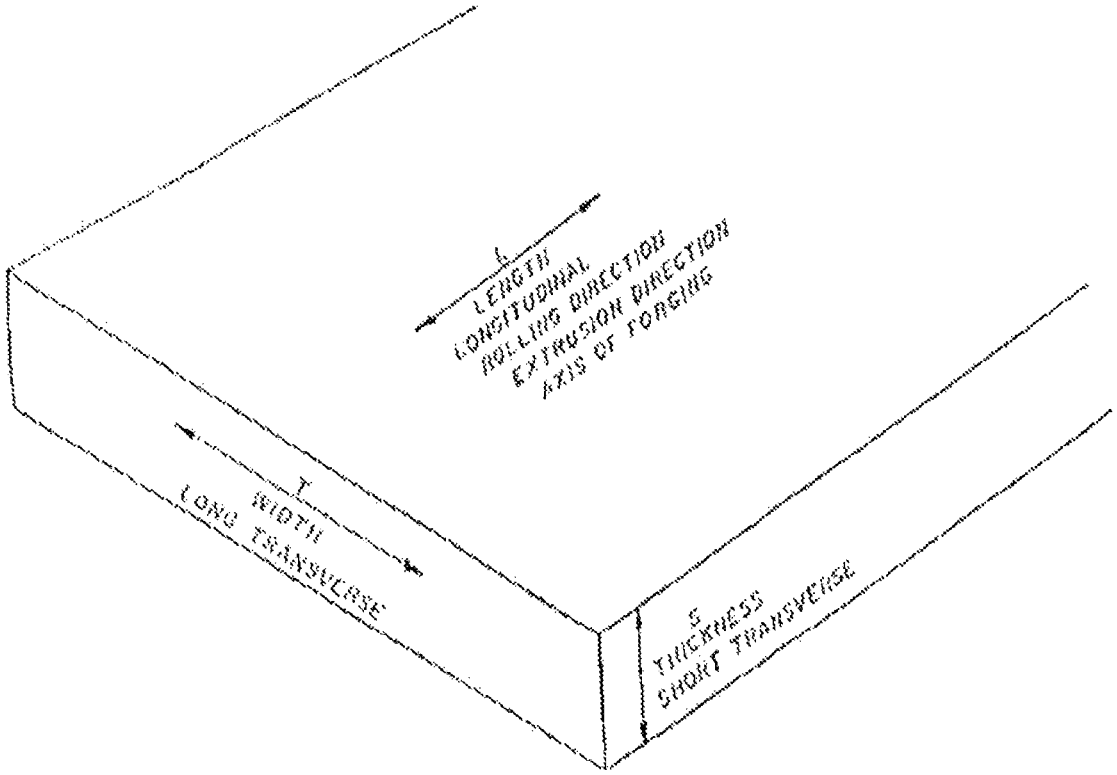
FIG. 15 is a schematic view illustrating the L, LT and ST directions of a rolled product.

As shown in FIG. 13, the new alloys reach near peak tensile yield strength more rapidly than the conventionally processed alloys. New alloys 19 and 20 also achieve comparable peak tensile yield strengths relative to their conventional counterpart alloys. New alloy 18 achieves a lower peak tensile yield strength than its conventional counterpart alloy, but would be expected to achieve a comparable tensile yield strength by imparting more work prior to quenching, as shown in Example 6, above.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. A method comprising:

(a) continuously casting, via a horizontal casting apparatus, a 7xxx heat treatable aluminum alloy strip;

(i) wherein the continuous casting comprises casting at a speed of 25-400 feet per minute and using roll separating forces of from 25 to 300 pounds per inch of width cast;

(ii) wherein the 7xxx heat treatable aluminum strip exits the casting apparatus at a temperature below its solidus temperature;

(iii) wherein the 7xxx heat treatable aluminum strip has a gauge of from 0.04 inch to 0.249 inch;

(b) after the continuously casting step, hot rolling and quenching the 7xxx heat treatable aluminum alloy strip;

(i) wherein the quenching occurs (a) during the hot rolling (b) after the hot rolling or (c) both during and after the hot rolling;

(c) after the hot rolling and quenching step, artificially aging the 7xxx heat treatable aluminum alloy strip;

wherein the method excludes both annealing of the 7xxx heat treatable aluminum alloy strip and solution heat treating of the 7xxx heat treatable aluminum alloy strip.

2. The method of claim 1, comprising:

after the quenching step (b) and prior to the artificially aging step, cold rolling the 7xxx heat treatable aluminum alloy strip.

3. The method of claim 2, wherein the continuously casting step (a) comprises:

(A) delivering a molten aluminum alloy to a pair of spaced apart rotating casting rolls defining a nip therebetween;

(B) advancing the molten aluminum alloy between surfaces of the casting rolls, wherein a freeze front of metal is formed at the nip; and (C) withdrawing the 7xxx heat treatable aluminum alloy strip from the nip.

4. The method of claim 2, wherein the continuously casting step (a) comprises:

(A) delivering a molten aluminum alloy to a pair of spaced apart rotating casting rolls defining a nip therebetween;

(B) advancing the molten aluminum alloy between surfaces of the casting rolls, wherein the advance comprises:

(I) first forming two solid outer regions adjacent surfaces of the casting rolls;

(II) second forming a semi-solid inner region containing dendrites of the molten aluminum alloy;

(III) wherein the inner region is located between the two outer concentration regions;

(IV) wherein the first forming and second forming steps are completed concomitant to one another;

(V) breaking the dendrites in the inner region at or before the nip; and (C) solidifying the semi-solid inner region to produce the 7xxx heat treatable aluminum alloy strip comprised of the inner region and the outer regions.

5. The method of claim 4, wherein breaking the dendrites in the inner region is completed at or before the nip, and wherein solidification of the inner region is completed at the nip.

6. The method of claim 4, wherein the casting rolls are rotating at a casting speed ranging between 25 to 400 feet per minute.

7. The method of claim 4, wherein a roll separating force applied by the casting rolls to the molten aluminum alloy passing though the nip is between 25 to 300 pounds per inch of width of the strip.

8. The method of claim 4, wherein the casting rolls each have a textured surface, and wherein the method comprises brushing the textured surfaces of the casting rolls.

9. The method of claim 2, wherein the method consists of steps (a), (b), and the artificial aging step (c).

* * * * *